US008992252B2

(12) United States Patent
McClellan et al.

(10) Patent No.: US 8,992,252 B2
(45) Date of Patent: Mar. 31, 2015

(54) RECEPTACLE ASSEMBLY FOR A MIDPLANE CONNECTOR SYSTEM

(71) Applicant: Tyco Electronics Corporation, Berwyn, PA (US)

(72) Inventors: Justin Shane McClellan, Camp Hill, PA (US); Jeffrey Byron McClinton, Harrisburg, PA (US); James Lee Fedder, Etters, PA (US); Justin Pickel, Hummelstown, PA (US); Timothy Robert Minnick, Enola, PA (US); Dharmendra Saraswat, Harrisburg, PA (US); Alex Michael Sharf, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 170 days.

(21) Appl. No.: 13/718,137

(22) Filed: Dec. 18, 2012

(65) Prior Publication Data

US 2013/0288525 A1 Oct. 31, 2013

Related U.S. Application Data

(60) Provisional application No. 61/638,897, filed on Apr. 26, 2012.

(51) Int. Cl.
*H01R 13/648* (2006.01)
*H01R 13/6581* (2011.01)
*H01R 13/6587* (2011.01)

(52) U.S. Cl.
CPC ..... *H01R 13/6581* (2013.01); *H01R 13/6587* (2013.01)
USPC ..... 439/607.05; 439/108

(58) Field of Classification Search
CPC ... H01R 13/658; H01R 23/005; H01R 23/688
USPC ..... 439/101, 108, 607.05–607.08, 607.1, 439/607.11, 607.56, 941
See application file for complete search history.

(56) References Cited

U.S. PATENT DOCUMENTS

| | | | | |
|---|---|---|---|---|
| 8,398,431 | B1 * | 3/2013 | Whiteman et al. | 439/607.06 |
| 8,398,432 | B1 * | 3/2013 | McClellan et al. | 439/607.07 |
| 8,419,472 | B1 * | 4/2013 | Swanger et al. | 439/607.07 |
| 8,444,434 | B2 * | 5/2013 | Davis et al. | 439/607.07 |
| 8,500,487 | B2 * | 8/2013 | Morgan et al. | 439/607.06 |
| 8,579,636 | B2 * | 11/2013 | Davis et al. | 439/65 |
| 8,591,260 | B2 * | 11/2013 | Davis et al. | 439/607.55 |
| 8,597,052 | B2 * | 12/2013 | Davis et al. | 439/607.08 |
| 2009/0061684 | A1 * | 3/2009 | Cohen et al. | 439/608 |

* cited by examiner

*Primary Examiner* — Thanh Tam Le

(57) ABSTRACT

A receptacle assembly includes a contact module having a conductive holder and a frame assembly received in the conductive holder and electrically shielded by the conductive holder. The frame assembly has a plurality of receptacle signal contacts having mating portions extending from the conductive holder. The receptacle signal contacts are arranged in differential pairs carrying differential signals. Ground shields are received in the conductive holder between the frame assembly and the conductive holder. The ground shields have grounding beams extending along the mating portions of the receptacle signal contacts. The grounding beams are arranged on four sides of each differential pair of the receptacle signal contacts.

20 Claims, 14 Drawing Sheets

RECEPTACLE ASSEMBLY FOR A MIDPLANE CONNECTOR SYSTEM

CROSS REFERENCE TO RELATED APPLICATIONS

This application claims the benefit of U.S. Provisional Application No. 61/638,897 filed Apr. 26, 2012, the subject matter of which is herein incorporated by reference in its entirety.

This application relates to U.S. Provisional Application No. 61/638,920 filed Apr. 26, 2012 and to U.S. Provisional Application No. 61/638,942 filed Apr. 26, 2012, the subject matter of both of which are herein incorporated by reference in their entirety.

BACKGROUND OF THE INVENTION

The subject matter herein relates generally to receptacle assemblies for use in midplane connector systems.

Some electrical systems, such as network switches and computer servers with switching capability, include receptacle connectors that are oriented orthogonally on opposite sides of a midplane in a cross-connect application. Switch cards may be connected on one side of the midplane and line cards may be connected on the other side of the midplane. The line card and switch card are joined through header connectors that are mounted on opposite sides of the midplane board. Typically, traces are provided on the sides and/or the layers of the midplane board to route the signals between the header connectors. Sometimes the line card and switch card are joined through header connectors that are mounted on the midplane in an orthogonal relation to one another. The connectors include patterns of signal and ground contacts that extend through a pattern of vias in the midplane.

However, conventional orthogonal connectors have experienced certain limitations. For example, it is desirable to increase the density of the signal and ground contacts within the connectors. Heretofore, the contact density has been limited in orthogonal connectors, due to the contact and via patterns. Conventional systems provide the needed 90° rotation within the midplane assembly, such as having each header providing 45° of rotation of the signal paths. In such systems, identical receptacle assemblies are used. However, the routing of the signals through the header connectors and midplane circuit board is complex, expensive and may lead to signal degradation.

Some connector systems avoid the 90° rotation in the midplane assembly by using a receptacle assembly on one side that is oriented 90° with respect to the receptacle assembly on the other side. Such connector systems have encountered problems with contact density and signal integrity.

A need remains for an improved orthogonal midplane connector system that has high contact density and improved signal integrity in differential pair applications.

BRIEF DESCRIPTION OF THE INVENTION

In one embodiment, a receptacle assembly is provided having a receptacle housing having a mating end and a contact module received in the housing. The contact module includes a conductive holder and a frame assembly received in the conductive holder and electrically shielded by the conductive holder. The frame assembly has a plurality of receptacle signal contacts having mating portions extending from the conductive holder. The receptacle signal contacts are arranged in differential pairs carrying differential signals.

Ground shields are received in the conductive holder between the frame assembly and the conductive holder. The ground shields have grounding beams extending along the mating portions of the receptacle signal contacts. The grounding beams are arranged on four sides of each differential pair of the receptacle signal contacts.

In a further embodiment, a receptacle assembly is provided including a receptacle housing having a mating end and a plurality of contact modules received in the housing. Each contact module includes a conductive holder and a frame assembly received in the conductive holder and electrically shielded by the conductive holder. The frame assembly has a plurality of receptacle signal contacts. The receptacle signal contacts have mating portions extending from the conductive holder. The receptacle signal contacts are arranged in differential pairs carrying differential signals. Ground shields are coupled to the conductive holder. The ground shields have grounding beams extending along the mating portions of the receptacle signal contacts. The grounding beams are configured to engage header ground shields of a header assembly. The grounding beams are arranged as beam sets with each beam set surrounding a different differential pair of receptacle signal contacts. The grounding beams of each beam set are configured to engage more than one header ground shield.

In a further embodiment, a receptacle assembly is provided including a receptacle housing having a mating end and a contact module received in the housing. The contact module includes a conductive holder having a mating end and a frame assembly received in the conductive holder and electrically shielded by the conductive holder. The frame assembly has a plurality of receptacle signal contacts having mating portions extending from the conductive holder beyond the mating end. The receptacle signal contacts are arranged in differential pairs carrying differential signals. The receptacle signal contacts have a lateral width measured from an outside edge of one receptacle signal contact of each pair to an opposite outside edge of the other receptacle signal contact of each pair. Ground shields are coupled to the conductive holder. The ground shields have grounding beams extending longitudinally beyond the mating end of the conductive holder along the mating portions of the receptacle signal contacts. Each grounding beam has a base portion proximal the mating end of the conductive holder and a tail portion distal of the mating end of the conductive holder. The base portion has a base width at least as wide as the lateral width. The tail portion is narrower than the base portion. The base portion extends at least half of a longitudinal length of the grounding beam.

DETAILED DESCRIPTION OF THE INVENTION

Figure 1:
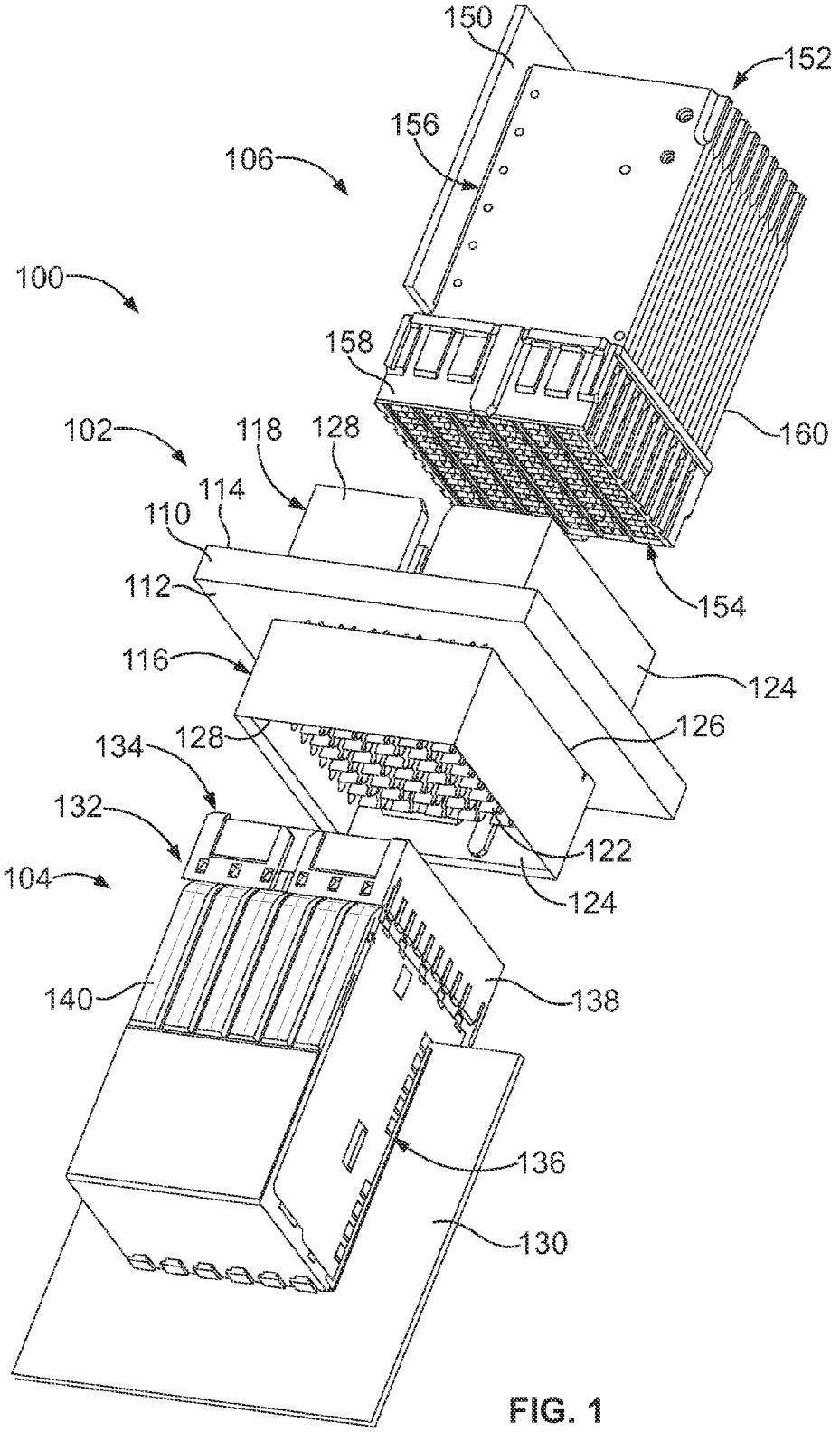
FIG. 1 is a perspective view of a midplane connector system formed in accordance with an exemplary embodiment.

FIG. 1 is a perspective view of a midplane connector system 100 formed in accordance with an exemplary embodiment. The midplane connector system 100 includes a midplane assembly 102, a first connector assembly 104 configured to be coupled to one side of the midplane assembly 102 and a second connector assembly 106 configured to be connected to a second side the midplane assembly 102. The midplane assembly 102 is used to electrically connect the first and second connector assemblies 104, 106. Optionally, the first connector assembly 104 may be part of a daughter card and the second connector assembly 106 may be part of a backplane, or vice versa. The first and second connector assemblies 104, 106 may be line cards or switch cards.

The midplane assembly 102 includes a midplane circuit board 110 having a first side 112 and second side 114. The midplane assembly 102 includes a first header assembly 116 mounted to and extending from the first side 112 of the midplane circuit board 110. The midplane assembly 102 includes a second header assembly 118 mounted to and extending from the second side 114 of the midplane circuit board 110. The first and second header assemblies 116, 118 each include header signal contacts 120 (shown in FIG. 2) electrically connected to one another through the midplane circuit board 110.

The midplane assembly 102 includes a plurality of signal paths therethrough defined by the header signal contacts 120 and conductive vias that extend through the midplane circuit board 110. The header signal contacts 120 of the first and second header assemblies 116, 118 are received in the same conductive via to define a signal path through the midplane assembly 102. In an exemplary embodiment, the signal paths pass straight through the midplane assembly 102 along linear paths. Such a design of the midplane circuit board 110 is less complex and less expensive to manufacture than a circuit board that routes traces between different vias to connect the first and second header assemblies 116, 118.

In an exemplary embodiment, the first and second header assemblies 116, 118 may be identical to one another. Having the first and second header assemblies 116, 118 identical to one another reduces the overall number of different parts that are needed for the midplane connector system 100. The first and second header assemblies 116, 118 may have an identical pinout allowing the first and second header assemblies 116, 118 to be mounted to the midplane circuit board 110 using conductive vias that pass straight through the midplane circuit board 110 between the first side 112 and the second side 114. The first and second header assemblies 116, 118 are not rotated 90° relative to one another as is typical of conventional connector systems, and thus do not suffer from a loss in density or a loss in performance as is typical of such connector systems. The header assemblies 116, 118 may be rotated 180° relative to one another to facilitate different card positions.

The first and second header assemblies 116, 118 include header ground shields 122 that provide electrical shielding around corresponding header signal contacts 120. In an exemplary embodiment, the header signal contacts 120 are arranged in pairs configured to convey differential signals. The header ground shields 122 peripherally surround a corresponding pair of the header signal contacts 120. In an exemplary embodiment, the header ground shields 122 are C-shaped, covering three sides of the pair of header signal contacts 120. One side of the header ground shield 122 is open. In the illustrated embodiment, the header ground shields 122 have an open bottom, but the header ground shield 122 below the open bottom provides shielding across the open bottom. Each pair of header signal contacts 120 is therefore surrounded on all four sides thereof using the C-shaped header ground shield 122 and the header ground shield 122 below the pair of header signal contacts 120.

The first and second header assemblies 116, 118 each include a header housing 124 that holds the header signal contacts 120 and the header ground shields 122. The header housing 124 is manufactured from a dielectric material, such as a plastic material. The header housing 124 includes a base 126 configured to be mounted to the midplane circuit board 110. The header housing 124 includes shroud walls 128 extending from the base 126. The shroud walls 128 cover portions of the header signal contacts 120 and header ground shields 122. The connector assemblies 104, 106 are coupled to the shroud walls 128. The shroud walls 128 may guide the connector assemblies 104, 106 during mating with the header assemblies 116, 118 respectively.

In alternative embodiments, the first and second header assemblies 116, 118 may include contact modules loaded into a housing, similar to the connector assemblies 104, 106. Optionally, the first and second header assemblies 116, 118 may be mounted to cables rather than the midplane circuit board 110.

The first connector assembly 104 includes a first circuit board 130 and a first receptacle assembly 132 coupled to the first circuit board 130. The first receptacle assembly 132 is configured to be coupled to the first header assembly 116. The first receptacle assembly 132 has a header interface 134 configured to be mated with the first header assembly 116. The first receptacle assembly 132 has a board interface 136 configured to be mated with the first circuit board 130. In an exemplary embodiment, the board interface 136 is orientated perpendicular with respect to the header interface 134. When the first receptacle assembly 132 is coupled to the first header assembly 116, the first circuit board 130 is orientated perpendicular with respect to the midplane circuit board 110.

The first receptacle assembly 132 includes a receptacle housing 138 that holds a plurality of contact modules 140. The contact modules 140 are held in a stacked configuration generally parallel to one another. The contact modules 140 hold a plurality of receptacle signal contacts 142 (shown in FIG. 3) that are electrically connected to the first circuit board 130 and define signal paths through the first receptacle assembly 132. The receptacle signal contacts 142 are configured to be electrically connected to the header signal contacts 120 of the first header assembly 116. In an exemplary embodiment, the contact modules 140 provide electrical shielding for the receptacle signal contacts 142. Optionally, the receptacle signal contacts 142 may be arranged in pairs carrying differential signals. In an exemplary embodiment, the contact modules 140 generally provide 360° shielding for each pair of receptacle signal contacts 142 along substantially the entire length of the receptacle signal contacts 142 between the board interface 136 and the header interface 134. The shield structure of the contact modules 140 that provides the electrical shielding for the pairs of receptacle signal contacts 142 is electrically connected to the header ground shields 122 of the first header assembly 116 and is electrically connected to a ground plane of the first circuit board 130.

The second connector assembly 106 includes a second circuit board 150 and a second receptacle assembly 152 coupled to the second circuit board 150. The second receptacle assembly 152 is configured to be coupled to the second header assembly 118. The second receptacle assembly 152 has a header interface 154 configured to be mated with the second header assembly 118. The second receptacle assembly 152 has a board interface 156 configured to be mated with the second circuit board 150. In an exemplary embodiment, the board interface 156 is oriented perpendicular with respect to the header interface 154. When the second receptacle assembly 152 is coupled to the second header assembly 118, the second circuit board 150 is oriented perpendicular with respect to the midplane circuit board 110. The second circuit board 150 is oriented perpendicular to the first circuit board 130.

The second receptacle assembly 152 includes a receptacle housing 158 that holds a plurality of contact modules 160. The contact modules 160 are held in a stacked configuration generally parallel to one another. The contact modules 160 hold a plurality of receptacle signal contacts 162 (shown in FIG. 4) that are electrically connected to the second circuit board 150 and define signal paths through the second receptacle assembly 152. The receptacle signal contacts 162 are configured to be electrically connected to the header signal contacts 120 of the second header assembly 118. In an exemplary embodiment, the contact modules 160 provide electrical shielding for the receptacle signal contacts 162. Optionally, the receptacle signal contacts 162 may be arranged in pairs carrying differential signals. In an exemplary embodiment, the contact modules 160 generally provide 360° shielding for each pair of receptacle signal contacts 162 along substantially the entire length of the receptacle signal contacts 162 between the board interface 156 and the header interface 154. The shield structure of the contact modules 160 that provides the electrical shielding for the pairs of receptacle signal contacts 162 is electrically connected to the header ground shields 122 of the second header assembly 118 and is electrically connected to a ground plane of the second circuit board 150.

In the illustrated embodiment, the first circuit board 130 is oriented generally horizontally. The contact modules 140 of the first receptacle assembly 132 are orientated generally vertically. The second circuit board 150 is oriented generally vertically. The contact modules 160 of the second receptacle assembly 152 are oriented generally horizontally. The first connector assembly 104 and the second connector assembly 106 have an orthogonal orientation with respect to one another. The signal contacts within each differential pair, including the receptacle signal contacts 142 of the first receptacle assembly 132, the receptacle signal contacts 162 of the second receptacle assembly 152, and the header signal contacts 120, are all oriented generally horizontally. Optionally, the first and/or second receptacle assemblies 132, 152 may be mounted to cables rather than the circuit boards 130, 150.

Figure 2:
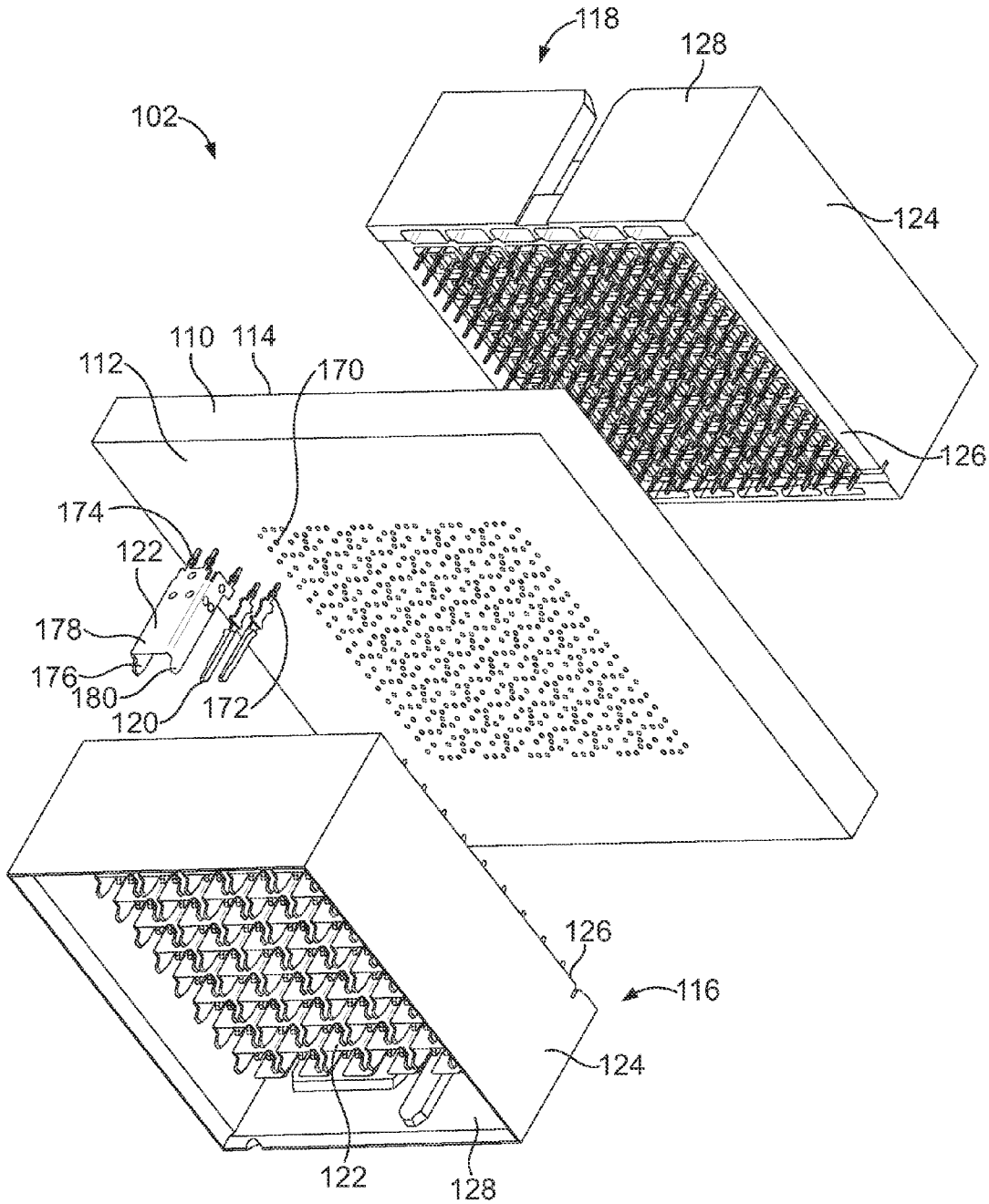
FIG. 2 is an exploded view of a midplane assembly showing first and second header assemblies poised for mounting to a midplane circuit board.

FIG. 2 is an exploded view of the midplane assembly 102 showing the first and second header assemblies 116, 118 poised for mounting to the midplane circuit board 110. A plurality of conductive vias 170 extend through the midplane circuit board 110 between the first and second sides 112, 114. The vias 170 extend straight through the midplane circuit board 110. No traces are needed along the midplane circuit board 110 to interconnect vias on one side of the midplane circuit board 110 with vias on the other side of the midplane circuit board 110 as is typical with conventional midplane circuit boards that have the header assemblies rotated 90°. Having the vias 170 pass straight through the midplane circuit board 110 and eliminating traces between the vias allows for better performance and reduces the cost of the midplane circuit board 110. The conductive vias 170 receive the header signal contacts 120 of the first and second header assemblies 116, 118. Some of the conductive vias 170 are configured to receive the header ground shields 122. The conductive vias 170 that receive the header ground shields 122 may surround the pair of conductive vias 170 that receive the corresponding pair of header signal contacts 120. The same conductive vias 170 receive header ground shields 122 of both header assemblies 116, 118 to directly connect such header ground shields 122. The same conductive vias 170 receive header signal contacts 120 of both header assemblies 116, 118 to directly connect such header signal contacts 120.

In an exemplary embodiment, the header signal contacts 120 include compliant pins 172 that are configured to be loaded into corresponding conductive vias 170. The compliant pins 172 are mechanically and electrically connected to the conductive vias 170. The header signal contacts 120 may be pins at the mating end, or may have other types of mating interfaces in alternative embodiments, such as sockets, blades, spring beams and the like. In an exemplary embodiment, the header ground shields 122 include compliant pins 174 that are configured to be received in corresponding conductive vias 170. The compliant pins 174 are mechanically and electrically connected to the conductive vias 170.

The header ground shields 122 are C-shaped and provide shielding on three sides of the pair of header signal contacts 120. The header ground shields 122 have a plurality of walls, such as three planar walls 176, 178, 180. The walls 176, 178, 180 may be integrally formed or alternatively, may be separate pieces. The compliant pins 174 extend from each of the walls 176, 178, 180 to electrically connect the walls 176, 178, 180 to the midplane circuit board 110. The wall 178 defines a center wall or top wall of the header ground shield 122. The walls 176, 180 define side walls that extend from the center wall 178. The side walls 176, 180 may be generally perpendicular with respect to the center wall 178. The bottom of each header ground shield 122 is open between the side walls 176, 180. The header ground shield 122 associated with another pair of header signal contacts 120 provides shielding along the open, fourth side thereof such that each of the pairs of header signal contacts 120 is shielded from each adjacent pair in the same column and the same row. For example, the top wall 178 of a first header ground shield 122 which is below a second header ground shield 122 provides shielding across the open bottom of the C-shaped second header shield 122.

Other configurations or shapes for the header ground shields 122 are possible in alternative embodiments. More or less walls may be provided in alternative embodiments. The walls may be bent or angled rather than being planar. In other alternative embodiments, the header ground shields 122 may provide shielding for individual header signal contacts 120 or sets of contacts having more than two header signal contacts 120.

Figure 3:
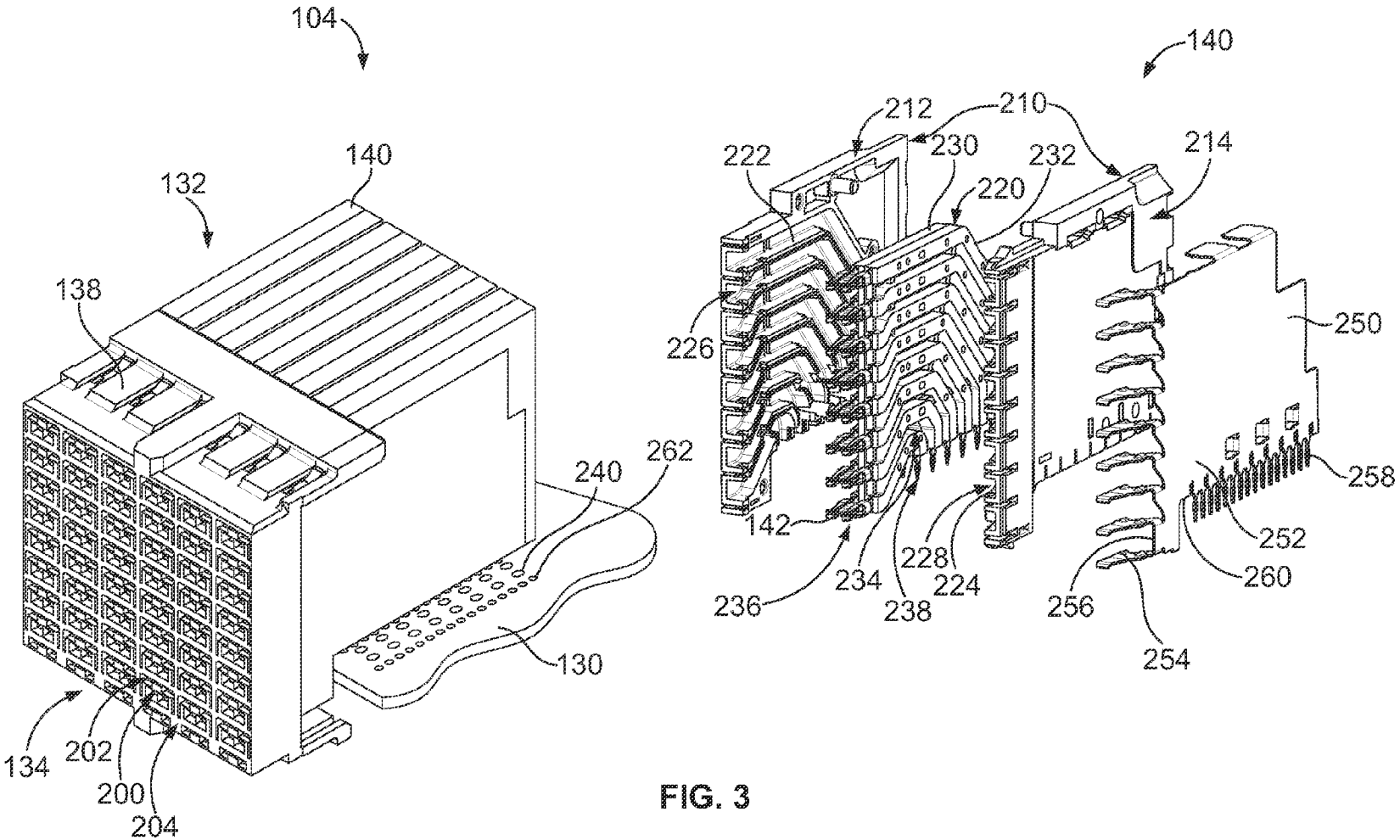
FIG. 3 is a front, exploded perspective view of a first receptacle assembly formed in accordance with an exemplary embodiment.

FIG. 3 is a front, exploded perspective view of the first receptacle assembly 132 formed in accordance with an exemplary embodiment. FIG. 3 illustrates one of the contact modules 140 in an exploded state and poised for assembly and loading into the receptacle housing 138. The receptacle housing 138 includes a plurality of signal contact openings 200 and a plurality of ground contacts openings 202 at a mating end 204 of the receptacle housing 138. The mating end 204 defines the header interface 134 of the first receptacle assembly 132.

The contact modules 140 are coupled to the receptacle housing 138 such that the receptacle signal contacts 142 are received in corresponding signal contact openings 200. Optionally, a single receptacle signal contact 142 is received in each signal contact opening 200. The signal contact openings 200 may also receive corresponding header signal contacts 120 (shown in FIG. 2) therein when the receptacle and header assemblies 132, 116 are mated. The ground contact openings 202 receive corresponding header ground shields 122 (shown in FIG. 2) therein when the receptacle and header assemblies 132, 116 are mated. The ground contact openings 202 receive grounding members, such as grounding beams of the contact modules 140 that mate with the header ground shields 122 to electrically common the receptacle and header assemblies 132, 116.

The receptacle housing 138 is manufactured from a dielectric material, such as a plastic material, and provides isolation between the signal contact openings 200 and the ground contact openings 202. The receptacle housing 138 isolates the receptacle signal contacts 142 and the header signal contacts 120 from the header ground shields 122. The receptacle housing 138 isolates each set of receptacle and header signal contacts 142, 120 from other sets of receptacle and header signal contacts 142, 120.

The ground contact openings 202 are C-shaped in the illustrated embodiment to receive the C-shaped header ground shields 122. Other shapes are possible in alternative embodiments, such as when other shaped header ground shields 122 are used. The signal contact openings 200 are chamfered at the mating end 204 to guide the header signal contacts 120 into the signal contact openings 200 during mating.

The contact module 140 includes a conductive holder 210, which in the illustrated embodiment includes a first holder member 212 and a second holder member 214 that are coupled together to form the holder 210. The holder members 212, 214 are fabricated from a conductive material. For example, the holder members 212, 214 may be die cast from a metal material. Alternatively, the holder members 212, 214 may be stamped and formed or may be fabricated from a plastic material that has been metalized or coated with a metallic layer. By having the holder members 212, 214 fabricated from a conductive material, the holder members 212, 214 may provide electrical shielding for the first receptacle assembly 132. When the holder members 212, 214 are coupled together, the holder members 212, 214 define at least a portion of a shield structure to provide electrical shielding for the receptacle signal contacts 142.

The conductive holder 210 holds a frame assembly 220, which includes the receptacle signal contacts 142. The holder members 212, 214 provide shielding around the frame assembly 220 and receptacle signal contacts 142. The holder members 212, 214 include tabs 222, 224 that extend inward toward one another to define discrete channels 226, 228, respectively. The tabs 222, 224 define at least a portion of a shield structure that provides electrical shielding around the receptacle signal contacts 142. The tabs 222, 224 are configured to extend into the frame assembly 220 such that the tabs 222, 224 are positioned between receptacle signal contacts 142 to provide shielding between corresponding receptacle signal contacts 142. In alternative embodiments, one holder member 212 or 214 could have a tab that accommodates the entire frame assembly 220 and the other holder member 212 or 214 acts as a lid.

The frame assembly 220 includes a pair of dielectric frames 230, 232 surrounding the receptacle signal contacts 142. In an exemplary embodiment, the receptacle signal contacts 142 are initially held together as leadframes (not shown), which, are overmolded with dielectric material to form the dielectric frames 230, 232. Other manufacturing processes may be utilized to form the dielectric frames 230, 232 other than overmolding a leadframe, such as loading receptacle signal contacts 142 into a formed dielectric body. The dielectric frames 230, 232 include openings 234 that receive the tabs 222, 224. The openings 234 are located between adjacent receptacle signal contacts 142 such that when the tabs 222, 224 are loaded into the openings 234, the tabs 222, 224 are positioned between adjacent receptacle signal contacts 142 to provide shielding between such receptacle signal contacts 142.

The receptacle signal contacts 142 have mating portions 236 extending from the front walls of the dielectric frames 230, 232 and mounting portions 238 extending from the bottom walls of the dielectric frames 230, 232. Other configurations are possible in alternative embodiments. The mating portions 236 and mounting portions 238 are the portions of the receptacle signal contacts 142 that extend from the dielectric frames 230, 232. In an exemplary embodiment, the mating portions 236 extend generally perpendicular with respect to the mounting portions 238. Inner portions or encased portions of the receptacle signal contacts 142 transition between the mating portions 236 and the mounting portions 238 within the dielectric frames 230, 232. The mating portions 236 are configured to be mated with, and electrically connected to, corresponding header signal contacts 120 (shown in FIG. 2). The mating portions 236 may have a split-beam type of connection, or may have other types of mating interfaces in alternative embodiments, such as pins, sockets, blades, and the like. The mounting portions 238 are configured to be electrically connected to the first circuit board 130. For example, the mounting portions 238 may include compliant pins that extend into conductive vias 240 in the first circuit board 130.

In an exemplary embodiment, the receptacle signal contacts 142 are arranged as differential pairs. In an exemplary embodiment, one of the receptacle signal contacts 142 of each pair is held by the dielectric frame 230 while the other receptacle signal contact 142 of the differential pair is held by the other dielectric frame 232. The receptacle signal contacts 142 of each pair extend through the frame assembly 220 generally along parallel paths such that the receptacle signal contacts 142 are skewless between the mating portions 236 and the mounting portions 238. Each contact module 140 holds both receptacle signal contacts 142 of each pair. The receptacle signal contacts 142 of the pairs are held in different columns. Each contact module 140 has two columns of receptacle signal contacts 142. One column is defined by the receptacle signal contacts 142 held by the dielectric frame 230 and another column is defined by the receptacle signal contacts 142 held by the dielectric frame 232. The receptacle signal contacts 142 of each pair are arranged in a row extending generally perpendicular with respect to the columns.

The holder members 212, 214 provide electrical shielding between and around respective pairs of the receptacle signal contacts 142. The holder members 212, 214 provide shielding from electromagnetic interference (EMI) and/or radio frequency interference (RFI). The holder members 212, 214 may provide shielding from other types of interference as well. The holder members 212, 214 prevent crosstalk between different pairs of receptacle signal contacts 142. The holder members 212, 214 provide electrical shielding around the outside of the frames 230, 232, and thus around the outside of all of the receptacle signal contacts 142, as well as between the receptacle signal contacts 142, such as between pairs of receptacle signal contacts 142 using the tabs 222, 224. The holder members 212, 214 control electrical characteristics, such as impedance control, crosstalk control, and the like, of the receptacle signal contacts 142.

In an exemplary embodiment, the contact module 140 includes a ground shield 250 coupled to one side of the conductive holder 210. The ground shield 250 includes a main body 252 that is generally planar and extends alongside of the second holder member 214. The ground shield 250 includes grounding beams 254 extending from a front 256 of the main body 252. The grounding beams 254 are configured to extend into the ground contact openings 202. The grounding beams 254 are configured to engage and be electrically connected to the header ground shields 122 (shown in FIG. 2) when the contact modules 140 are loaded into the receptacle housing 138 and when the first receptacle assembly 132 is coupled to the first header assembly 116. The grounding beams 254 may be deflectable. The grounding beams 254 are configured to be positioned between pairs of the receptacle signal contacts 142. For example, one grounding beam 254 is configured to be positioned above each pair of receptacle signal contacts 142 and another grounding beam 254 is configured to be positioned below each pair of receptacle signal contacts 142. The grounding beams 254 provide shielding along the mating portions 236 of the receptacle signal contacts 142. Optionally, other grounding beams may be provided along the sides of the mating portions 236 in addition to, or in the alternative to, the grounding beams 254 above and below the receptacle signal contacts 142. In alternative embodiments, two ground shields may be used, one on each side with each ground shield providing grounding beams.

The ground shield 250 includes ground pins 258 extending from a bottom 260 of the ground shield 250. The ground pins 258 may be compliant pins. The ground pins 258 are configured to be received in corresponding conductive vias 262 in the first circuit board 130. In the illustrated embodiment, the ground pins 258 are all arranged in a single column generally aligned with the main body 252. The ground pins 258 may be arranged in different locations in alternative embodiments. For example, at least some of the ground pins 258 may be bent inward into the conductive holder 210 such that the ground pins 258 are aligned with and positioned between the mounting portions 238 of corresponding receptacle signal contacts 142. In other embodiments, ground bars may be used that extend across all of the contact modules 140.

During assembly, the frame assembly 220 is loaded into the conductive holder 210. The first and second holder members 212, 214 are coupled together around the frame assembly 220. The ground shield 250 is coupled to the second holder member 214. The contact module 140 is then loaded into the rear of the receptacle housing 138. Once all of the contact modules 140 are loaded into the receptacle housing 138, the first receptacle assembly 132 may be mounted to the first circuit board 130 by loading the mounting portions 238 and the ground pins 258 into the conductive vias 240, 262, respectively.

Figure 4:
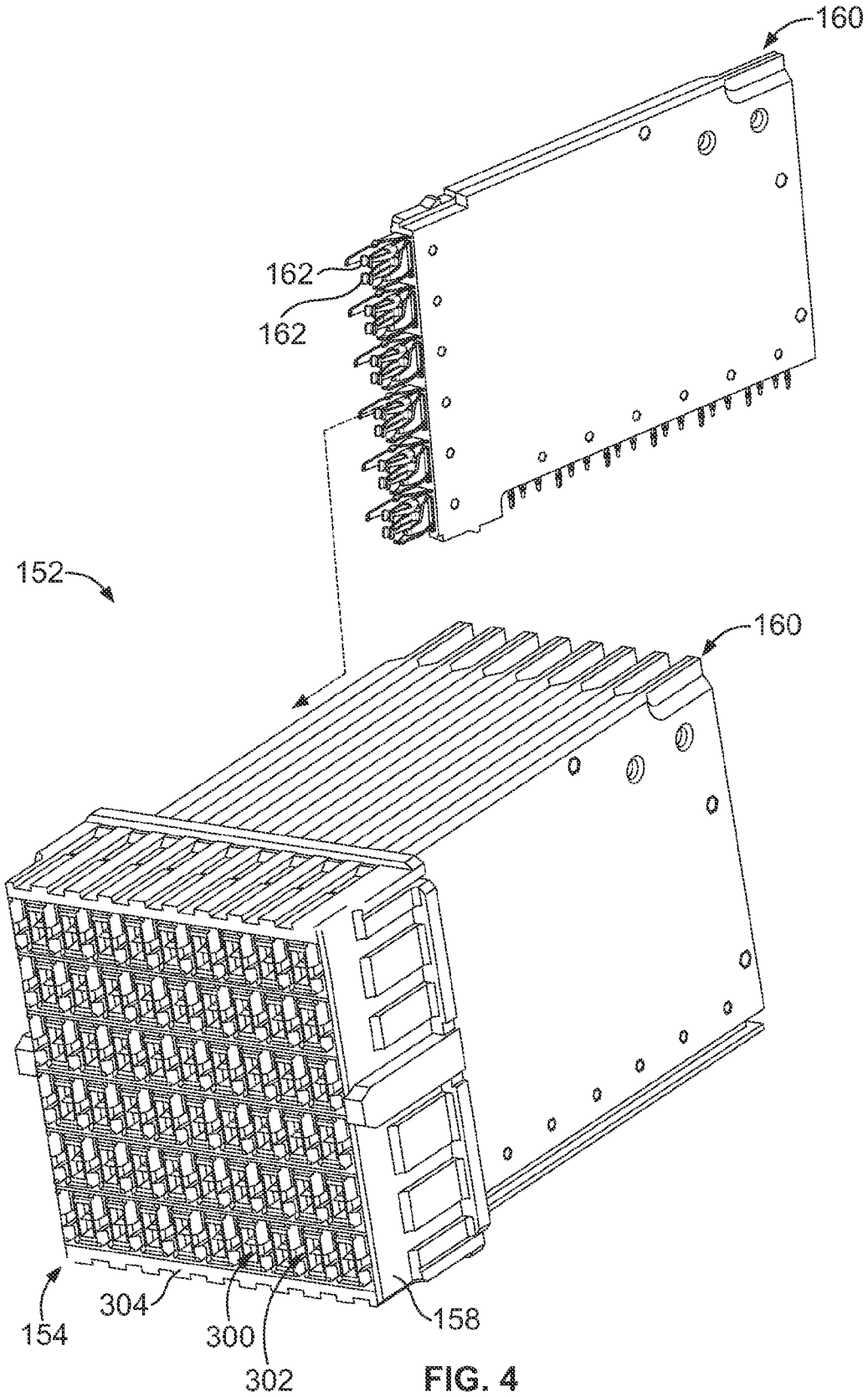
FIG. 4 is a front perspective view of a portion of a second receptacle assembly.

FIG. 4 is a front perspective view of the second receptacle assembly 152 showing one of the contact modules 160 poised for loading into the receptacle housing 158. The receptacle housing 158 includes a plurality of signal contact openings 300 and a plurality of ground contacts openings 302 at a mating end 304 of the receptacle housing 158. The mating end 304 defines the header interface 154 of the second receptacle assembly 152.

The contact modules 160 are coupled to the receptacle housing 158 such that the receptacle signal contacts 162 are received in corresponding signal contact openings 300. Optionally, a single receptacle signal contact 162 is received in each signal contact opening 300. The signal contact openings 300 may also receive corresponding header signal contacts 120 (shown in FIG. 2) therein when the receptacle and header assemblies 152, 118 are mated. The ground contact openings 302 receive corresponding header ground shields 122 (shown in FIG. 2) therein when the receptacle and header assemblies 152, 118 are mated. The ground contact openings 302 receive grounding members, such as grounding beams of the contact modules 160, which mate with the header ground shields 122 to electrically common the receptacle and header assemblies 152, 118.

The receptacle housing 158 is manufactured from a dielectric material, such as a plastic material, and provides isolation between the signal contact openings 300 and the ground contact openings 302. The receptacle housing 158 isolates the receptacle signal contacts 162 and the header signal contacts 120 from the header ground shields 122. The receptacle housing 158 isolates each set of receptacle and header signal contacts 162, 120 from other sets of receptacle and header signal contacts 162, 120.

The ground contact openings 302 are C-shaped in the illustrated embodiment to receive the C-shaped header ground shields 122. Other shapes are possible in alternative embodiments, such as when other shaped header ground shields 122 are used. The ground contact openings 302 are chamfered at the mating end 304 to guide the header ground shields 122 into the ground contact openings 302 during mating. The signal contact openings 300 are chamfered at the mating end 304 to guide the header signal contacts 120 into the signal contact openings 300 during mating.

Figure 5:
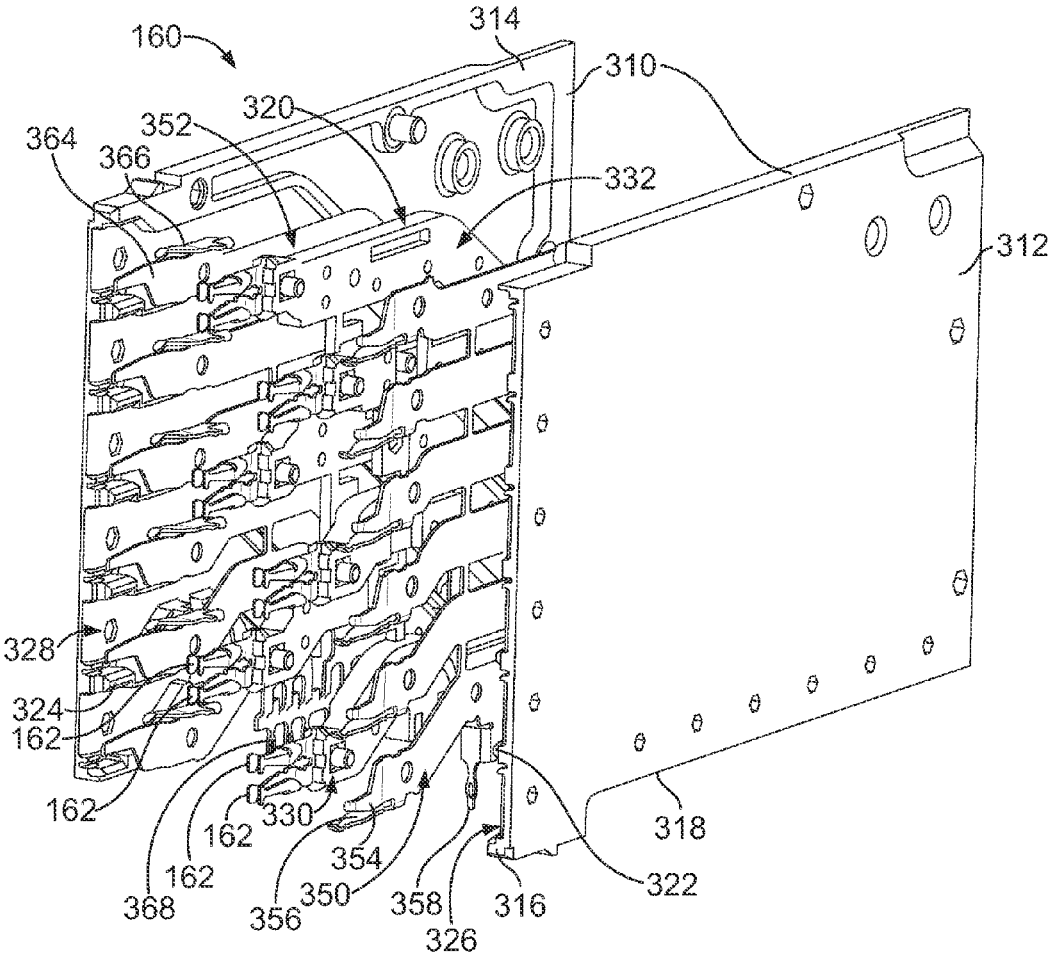
FIG. 5 is an exploded view of a contact module for the second receptacle assembly shown in FIG. 4.

FIG. 5 is an exploded view of the contact module 160. The contact module 160 includes a conductive holder 310, which in the illustrated embodiment includes a first holder member 312 and a second holder member 314 that are coupled together to form the holder 310. The conductive holder 310 has a mating end 316 and a mounting end 318.

The holder members 312, 314 are fabricated from a conductive material. For example, the holder members 312, 314 may be die cast from a metal material. Alternatively, the holder members 312, 314 may be stamped and formed or may be fabricated from a plastic material that has been metalized or coated with a metallic layer. By having the holder members 312, 314 fabricated from a conductive material, the holder members 312, 314 may provide electrical shielding for the second receptacle assembly 152. When the holder members 312, 314 are coupled together, the holder members 312, 314 define at least a portion of a shield structure to provide electrical shielding for the receptacle signal contacts 162.

The conductive holder 310 holds a frame assembly 320, which includes the receptacle signal contacts 162. The holder members 312, 314 provide shielding around the frame assembly 320 and receptacle signal contacts 162. The holder members 312, 314 include tabs 322, 324 that extend inward toward one another to define discrete, shielded channels 326, 328, respectively. Optionally, tabs may be provided on only the holder member 312 or the holder member 314 rather than on both holder members 312, 314. The tabs 322, 324 define at least a portion of a shield structure that provides electrical shielding around the receptacle signal contacts 162. The tabs 322, 324 are configured to extend into the frame assembly 320 such that the tabs 322, 324 are positioned between pairs of the receptacle signal contacts 162 to provide shielding between the corresponding pairs of the receptacle signal contacts 162.

The frame assembly 320 includes a first frame 330 and a second frame 332 that surround corresponding receptacle signal contacts 162. Optionally, the first frame 330 may be manufactured from a dielectric material overmolded over the corresponding receptacle signal contacts 162. The second frame 332 may be manufactured from a dielectric material overmolded over the corresponding receptacle signal contacts 162. The first and second frames 330, 332 are coupled together to form the frame assembly 320.

In an exemplary embodiment, the receptacle signal contacts 162 of the first frame 330 form part of a common leadframe that is overmolded to encase the receptacle signal contacts 162. The receptacle signal contacts 162 of the second frame 332 form part of a common leadframe, separate from the leadframe of the first frame 330, that is separately overmolded to encase the corresponding receptacle signal contacts 162. Other manufacturing processes may be utilized to form the dielectric frames 330, 332 other than overmolding leadframes.

The first and second frames 330, 332 are assembled such that the tabs 322, 324 extend therethrough between corresponding differential pairs of the receptacle signal contacts 162. The holder members 312, 314 provide electrical shielding between and around respective pairs of the receptacle signal contacts 162. The holder members 312, 314 provide shielding from electromagnetic interference (EMI) and/or radio frequency interference (RFI). The holder members 312, 314 may provide shielding from other types of interference as well. The holder members 312, 314 prevent crosstalk between different pairs of receptacle signal contacts 162. The holder members 312, 314 provide electrical shielding around the outside of the first and second frames 330, 332, and thus around the outside of all of the receptacle signal contacts 162, as well as between the receptacle signal contacts 162, such as between pairs of receptacle signal contacts 162 separated by the tabs 322, 324. The holder members 312, 314 control electrical characteristics, such as impedance control, crosstalk control, and the like, of the receptacle signal contacts 162.

The contact module 160 includes a first ground shield 350 and a second ground shield 352 that provide shielding for the receptacle signal contacts 162. The ground shields 350, 352 make ground terminations to the header ground shields 122 (shown in FIG. 1) and the second circuit board 150 (shown in FIG. 1). In an exemplary embodiment, the ground shields 350, 352 are internal ground shields positioned within the conductive holder 310. The ground shields 350, 352 are inlaid within the conductive holder 310. For example, the first ground shield 350 is laid in the first holder member 312 and positioned between the first holder member 312 and the frame assembly 320. The second ground shield 352 is laid in the second holder member 314 and positioned between the second holder member 314 and the frame assembly 320.

The first ground shield 350 includes flanking grounding beams 354 and in-column grounding beams 356 extending from a front thereof. The grounding beams 354, 356 are oriented generally perpendicular to each other. The grounding beams 354, 356 extend along different sides of the receptacle signal contacts 162. For example, the flanking grounding beams 354 may extend along a side of both receptacle signal contacts 162 out of column with respect to the receptacle signal contacts 162, while the in-column grounding beams 356 are in-column with the receptacle signal contacts 162. The grounding beams 354, 356 are configured to extend into the ground contact openings 302 (shown in FIG. 4). The grounding beams 354, 356 are configured to engage and be electrically connected to the header ground shields 122 (shown in FIG. 1) when the contact modules 160 are loaded into the receptacle housing 158 and when the second receptacle assembly 152 is coupled to the second header assembly 118. The grounding beams 354, 356 may be deflectable.

The first ground shield 350 includes ground pins 358 extending from a bottom of the ground shield 350. The ground pins 358 may be compliant pins. The ground pins 358 are configured to be received in corresponding conductive vias in the second circuit board 150.

The second ground shield 352 includes flanking grounding beams 364 and in-column grounding beams 366 extending from a front thereof. The grounding beams 364, 366 are oriented generally perpendicular to each other. The grounding beams 364, 366 extend along different sides of the receptacle signal contacts 162. For example, the flanking grounding beams 364 may extend along a side of both receptacle signal contacts 162 out of column with respect to the receptacle signal contacts 162 while the in-column grounding beams 366 are aligned in-column with the receptacle signal contacts 162 generally opposite the grounding beam 356. When assembled, the grounding beams 354, 356, 364, 366 are located on all four sides of the mating portions of the pair of receptacle signal contacts 162. The grounding beams 364, 366 are configured to extend into the ground contact openings 302. The grounding beams 364, 366 are configured to engage and be electrically connected to the header ground shields 122 (shown in FIG. 1) when the contact modules 160 are loaded into the receptacle housing 158 and when the second receptacle assembly 152 is coupled to the second header assembly 118. The grounding beams 364, 366 may be deflectable.

The second ground shield 352 includes ground pins 368 extending from a bottom of the second ground shield 352. The ground pins 368 may be compliant pins. The ground pins 368 are configured to be received in corresponding conductive vias in the second circuit board 150.

In an exemplary embodiment, the header assemblies 116, 118 (shown in FIG. 2) may be manufactured in a similar manner as the receptacle assemblies 132, 152, such as including contact modules received in a housing. The contact modules of the header assemblies may include inlaid ground shields that define the C-shaped ground shields or that have grounding beams on three or more sides of the header signal contacts.

Figure 6:
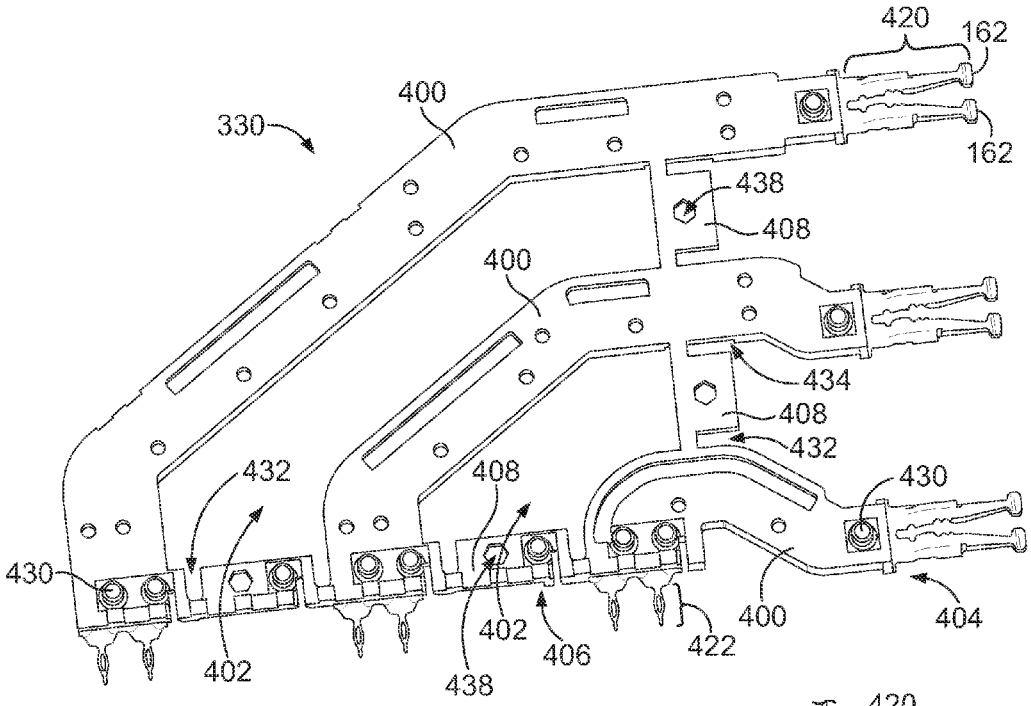
FIG. 6 is a side perspective view of a frame for the contact module formed in accordance with an exemplary embodiment.

FIG. 6 is a side perspective view of the first frame 330 formed in accordance with an exemplary embodiment. The first frame 330 includes a plurality of frame members 400 each supporting different differential pairs of receptacle signal contacts 162. The frame members 400 are separated by gaps 402. Any number of frame members 400 may be provided. In the illustrated embodiment, three frame members 400 are used corresponding to three differential pairs of receptacle signal contacts 162 of the first frame 330.

The frame members 400 extend between a mating end 404 of the first frame 330 and a mounting end 406 of the first frame 330. In the illustrated embodiment, the mating end 404 is generally perpendicular with respect to the mounting end 406, however other orientations are possible in alternative embodiments. The receptacle signal contacts 162 have mating portions 420 that extend from the frame members 400 beyond the mating end 404, and mounting portions 422 that extend from the frame members 400 beyond the mounting end 406, for electrical termination to other components such as the second header assembly 118 and the second circuit board 150 (both shown in FIG. 1).

The frame members 400 are connected by bridges 408 that span the gaps 402. The bridges 408 position the frame members 400 with respect to one another. The bridges 408 are co-molded with the frame members 400.

Figure 7:
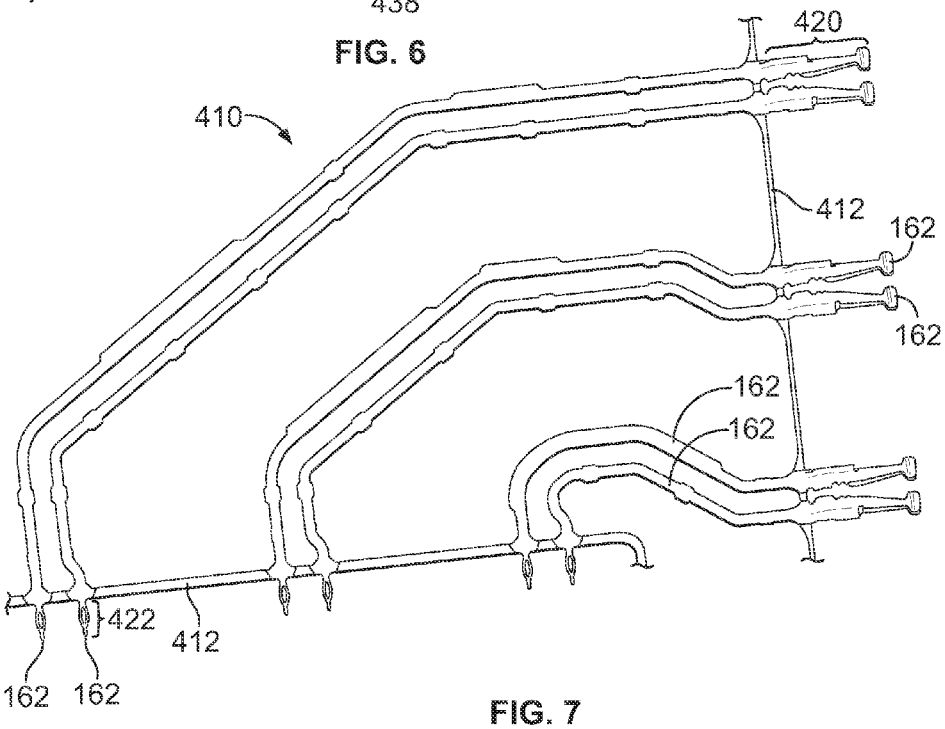
FIG. 7 illustrates a leadframe of the frame.

FIG. 7 illustrates a leadframe 410 of the frame assembly 320. The receptacle signal contacts 162 are formed as part of the leadframe 410. The leadframe 410 is a stamped and funned structure and is initially held together by a carrier 412 with connecting portions between each of the conductors defining the receptacle signal contacts 162. The carrier 412 is later removed after the receptacle signal contacts 162 are held by the frame members 400.

As illustrated in FIG. 7, the leadframe 410 is generally planar and defines a leadframe plane. The mating and mounting portions 420, 422 are integrally formed with the conductors of the leadframe 410. The conductors extend along predetermined paths between each mating portion 420 and corresponding mounting portion 422. The mating portions 420 are configured to be mated with and electrically connected to corresponding header signal contacts 120 (shown in FIG. 2). The mounting portions 422 are configured to be electrically connected to the second circuit board 150. For example, the mounting portions 420 may include compliant pins that extend into conductive vias in the second circuit board 150.

With reference back to FIG. 6, portions of the leadframe 410 are enclosed within the frame members 400. In an exemplary embodiment, portions of the leadframe 410 are exposed through the frame members 400 in certain areas. In some embodiments, the frame members 400 are manufactured using an overmolding process. During the overmolding process, a majority of the leadframe 410 is encased in a dielectric material which forms the frame members 400. The mating portions 420 extend from the mating end 404 along an edge of the frame members 400 (e.g. a front edge), and the mounting portions 422 extend from the mounting end 406 along another edge of the frame members 400 (e.g. a side edge).

The receptacle signal contacts 162 are arranged in pairs. One of the receptacle signal contacts 162 in each pair defines a radially inner receptacle signal contact (measured from the intersection between the mating and mounting ends of the contact module 160), while the other receptacle signal contact 162 in each pair defines a radially outer receptacle signal contact. The inner and outer receptacle signal contacts 162 have different lengths between the mating portions 420 and the mounting portions 422. In an exemplary embodiment, the radially outer receptacle signal contacts 162 are exposed to air through the frame members 400 for electrical compensation, such as to reduce electrical skew.

The frame members 400 include locating posts 430 extending therefrom. The locating posts 430 are configured to be received in corresponding openings in the conductive holder 310 (shown in FIG. 5) to locate and/or secure the first frame 330 within the conductive holder 310. In an exemplary embodiment, the bridges 408 near the mounting end 406 include locating channels 432 formed therethrough. The locating channels 432 receive tabs or other features of the conductive holder 310 to position and or secure the first frame 330 with respect to the conductive holder 310.

In an exemplary embodiment, at least some of the frame members 400 include troughs 434. The troughs 434 are recessed areas that are configured to receive portions of the second frame 332 (shown in FIG. 5). Optionally, the troughs 434 may be generally aligned with the bridges 408. Optionally, at least one frame coupling member (not shown) is located within each trough 434. The frame coupling member is configured to extend into the second frame 332 to position the first frame 330 with respect to the second frame 332.

In an exemplary embodiment, the bridges 408 include coupling members 438 that interact with corresponding coupling members of the second frame 332 to secure the first frame 330 with respect to the second frame 332. In the illustrated embodiment, the coupling members 438 constitute openings extending through the bridges 408. The openings receive posts or other types of coupling members therein. Other types of coupling members 438 may be provided on the bridges 408, such as post, slots, latches, or other types of fasteners.

Figure 8:
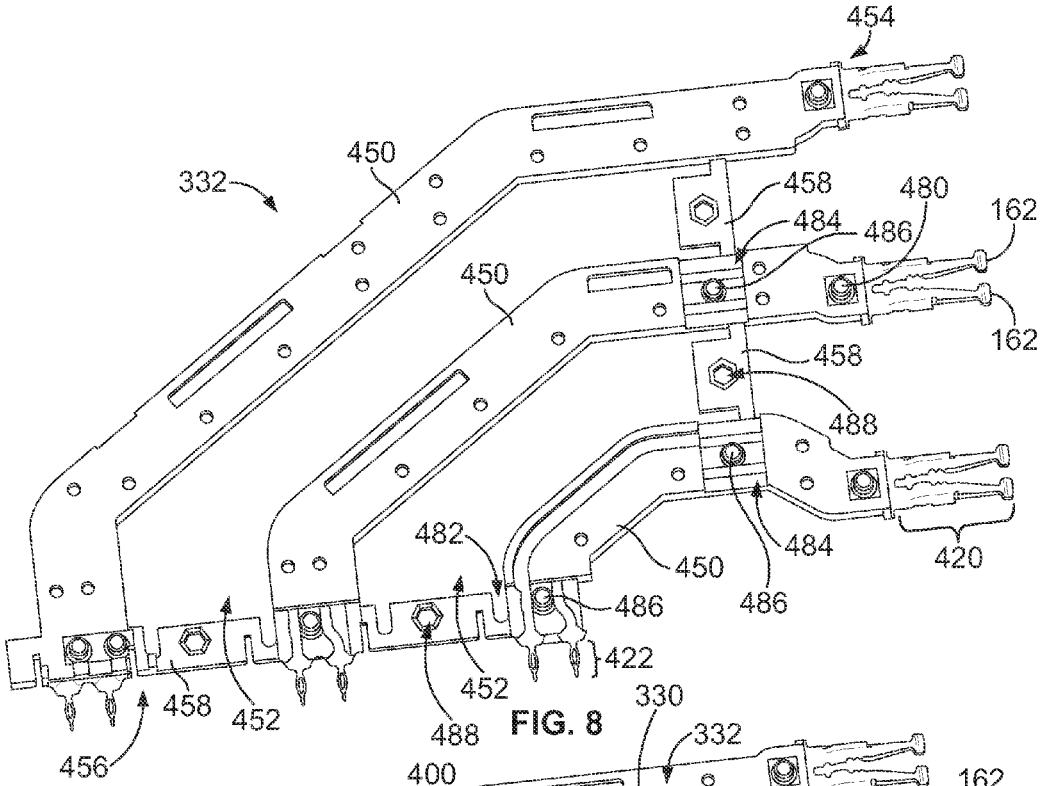
FIG. 8 is a side perspective view of another frame for the contact module formed in accordance with an exemplary embodiment.

FIG. 8 is a side perspective view of the second frame 332 formed in accordance with an exemplary embodiment. The second frame 332 includes a plurality of frame members 450 each supporting different differential pairs of receptacle signal contacts 162. The frame members 450 are separated by gaps 452. Any number of frame members 450 may be provided. In the illustrated embodiment, three frame members 450 are used corresponding to three differential pairs of receptacle signal contacts 162 of the second frame 332.

The frame members 450 extend between a mating end 454 of the second frame 332 and a mounting end 456 of the second frame 332. In the illustrated embodiment, the mating end 454 is generally perpendicular with respect to the mounting end 456, however other orientations are possible in alternative embodiments. The receptacle signal contacts 162 extend from the frame members 450 beyond the mating end 454 and beyond the mounting end 456 for electrical termination to other components, such as the second header assembly 118 and the second circuit board 150 (both shown in FIG. 1).

The frame members 450 are connected by bridges 458 that span the gaps 452. The bridges 458 position the frame members 450 with respect to one another. The bridges 458 are co-molded with the frame members 450.

In an exemplary embodiment, the second frame 332 includes a leadframe, similar to the leadframe 410 (shown in FIG. 7), where like components are identified by like reference numerals. The frame members 450 are overmolded over the receptacle signal contacts 162 defined by the leadframe. The receptacle signal contacts 162 are arranged in pairs. The mating portions 420 extend from the mating end 454 along an edge of the frame members 450 (e.g. a front edge), and the mounting portions 422 extend from the mounting end 456 along another edge of the frame members 450 (e.g. a side edge).

The frame members 450 include locating posts 480 extending therefrom. The locating posts 480 are configured to be received in corresponding openings in the conductive holder 310 (shown in FIG. 5) to locate and/or secure the second frame 332 within the conductive holder 310. In an exemplary embodiment, the bridges 458 near the mounting end 456 include locating channels 482 formed therethrough. The locating channels 482 receive tabs or other features of the conductive holder 310 to position and or secure the second frame 332 with respect to the conductive holder 310.

In an exemplary embodiment, at least some of the frame members 450 include troughs 484. The troughs 484 are recessed areas that are configured to receive portions of the first frame 330 (shown in FIG. 6). Optionally, the troughs 484 may be generally aligned with the bridges 458. Optionally, at least one frame coupling member 486 is located within each trough 484. The frame coupling member 486 is configured to extend into the first frame 330 to position the first frame 330 with respect to the second frame 332. Optionally, the frame coupling members 486 may also be used as locating posts, such as when the frame coupling members 486 are longer and are configured to extend into the conductive holder 310 in addition to extending through the coupling member 438 (shown in FIG. 6) of the first frame 330.

In an exemplary embodiment, the bridges 458 include coupling members 488 that interact with corresponding coupling members of the first frame 330 to secure the first frame 330 with respect to the second frame 332. In the illustrated embodiment, the coupling members 488 constitute openings extending through the bridges 458. The openings receive posts or other types of coupling members therein. Other types of coupling members 488 may be provided on the bridges 458, such as post, slots, latches, or other types of fasteners.

Figure 9:
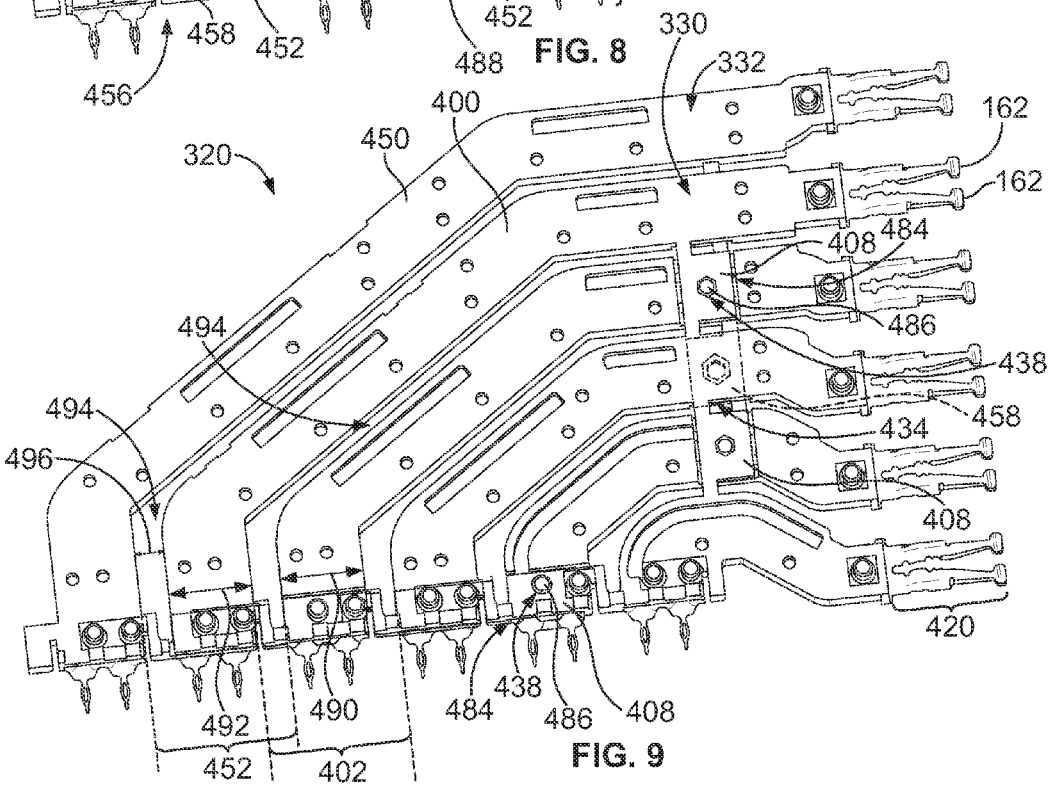
FIG. 9 is a side perspective view of a frame assembly showing the frame shown in FIG. 6 and the frame shown in FIG. 8 coupled together.

FIG. 9 is a side perspective view of the frame assembly 320 showing the first frame 330 and the second frame 332 coupled together. The first and second frames 330, 332 are internested such that the frame members 400 of the first frame 330 are received in corresponding gaps 452 of the second frame 332 between frame members 450 of the second frame 332. The first and second frames 330, 332 are interested such that the frame members 450 of the second frame 332 are received in corresponding gaps 402 of the first frame 330 between frame members 400 of the first frame 330. The first and second frames 330, 332 are internested such that the frame members 400, 450 of the first and second frames 330, 332 are generally co-planar. The frame members 400, 450 are arranged in an alternating sequence (e.g. frame member 400, frame member 450, frame member 400, frame member 450). Internesting the frame members 400, 450 positions the differential pairs of receptacle signal contacts 162 of the first frame 330 interspersed between corresponding differential pairs of receptacle signal contacts 162 of the second frame 332, and vice versa.

When the first and second frames 330, 332 are coupled together, the bridges 408 span across and engage corresponding frame members 450 of the second frame 332. For example, the bridges 408 are received in corresponding troughs 484. Similarly, the bridges 458 (also shown in FIG. 8) of the second frame 332 span across and engage corresponding frame members 400 of the first frame 330. For example, the bridges 458 are received in corresponding troughs 434 in the frame members 400. The coupling members 438 engage corresponding frame coupling members 486 to secure the first frame 330 with respect to the second frame 332.

In an exemplary embodiment, the gaps 402, 452 are sufficiently wide to accommodate the corresponding frame members 450, 400. For example, a width of the gaps 402 is wider than a width 490 of the frame members 450. Similarly, a width of the gaps 452 is wider than a width 492 of the frame members 400. In an exemplary embodiment, the widths, 490, 492 are dimensioned such that windows 494 are defined between the frame members 400, 450. A width 496 of the windows 494 may vary depending on the widths of the gaps 402, 452 and the widths 490, 492 of the frame members 450, 400. In an exemplary embodiment, the windows 494 are sized and shaped to receive the tabs 322, 324 (shown in FIG. 5) of the conductive holder 310 (shown in FIG. 5). Having the tabs 322, 324 in the windows 494 provides electrical shielding between each of the differential pairs of receptacle signal contacts 162.

Having the first frame 330 manufactured separately from the second frame 332 allows adequate spacing between the receptacle signal contacts 162 for stamping and forming the mating portions 420 of the receptacle signal contacts 162. For example, a dimension of material that is required to form the mating portions 420 may be greater than the desired spacing. In order to have the tight spacing between the receptacle signal contacts 162, the two frames 330, 332 are separately manufactured and coupled together.

Figure 10:
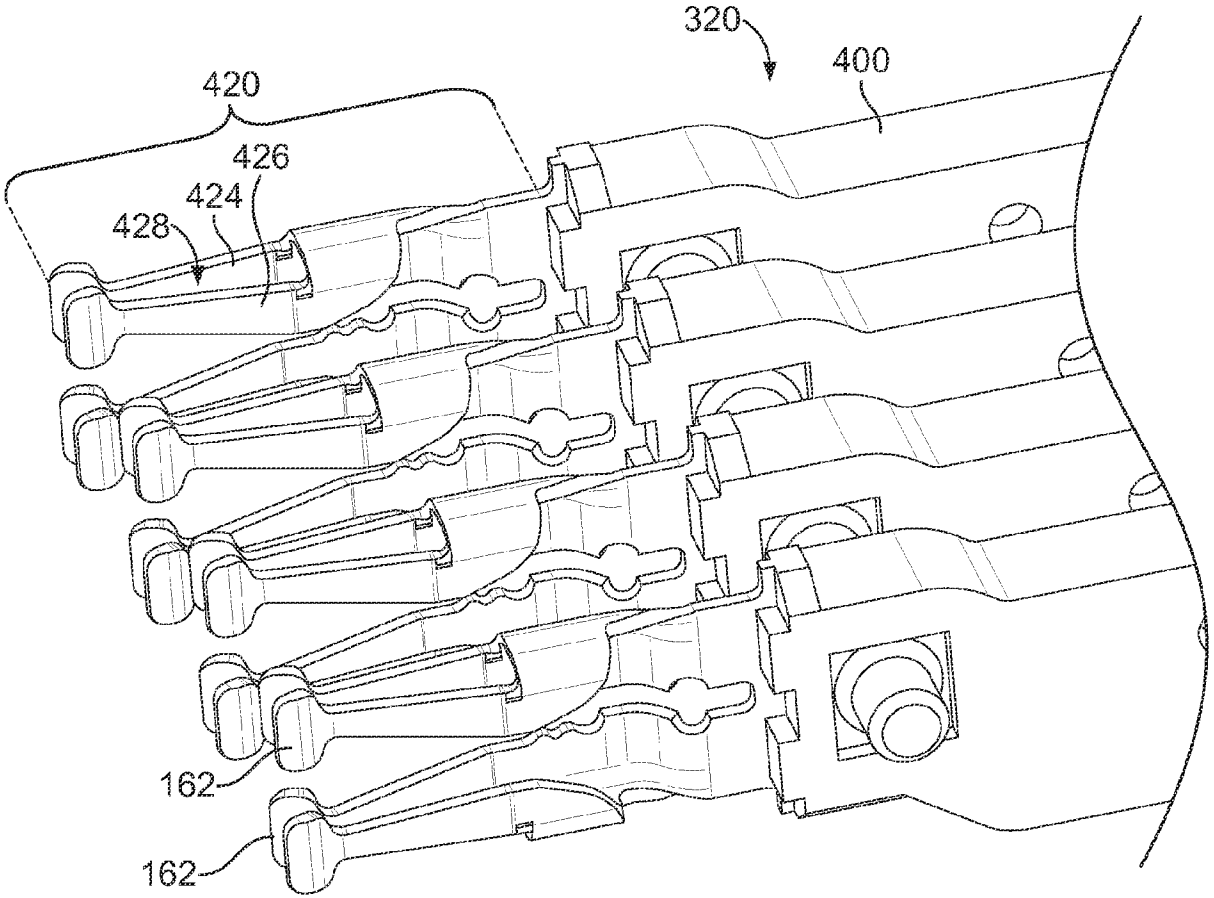
FIG. 10 illustrates portions of frame assemblies.

FIG. 10 illustrates portions of frame assemblies 320 illustrating the mating portions 420 of the receptacle signal contacts 162 extending from corresponding frame members 400. In the illustrated embodiment, the mating portions 420 define a wish bone type of contact having twin beams configured to receive a header signal contact 120 (shown in FIG. 2) therebetween. The mating portions 420 each have a primary beam 424 and a secondary beam 426 that is generally parallel to the primary beam 424 and spaced apart from the primary beam 424 across a gap 428. The beams 424, 426 are deflectable during mating with the header signal contact 120. The secondary beam 426 is folded over to oppose the primary beam 424. The folded over portion has a generally U-shaped configuration. In an exemplary embodiment, the secondary beams 426 of the receptacle signal contacts 162 of each differential pair are folded over in respective opposite directions. For example, one of the secondary beams 426 of each differential pair is folded over in a clockwise direction (when viewed from the front) while the other secondary beam 426 of the differential pair is folded over in a counter-clockwise direction (when viewed from the front).

Figure 11:
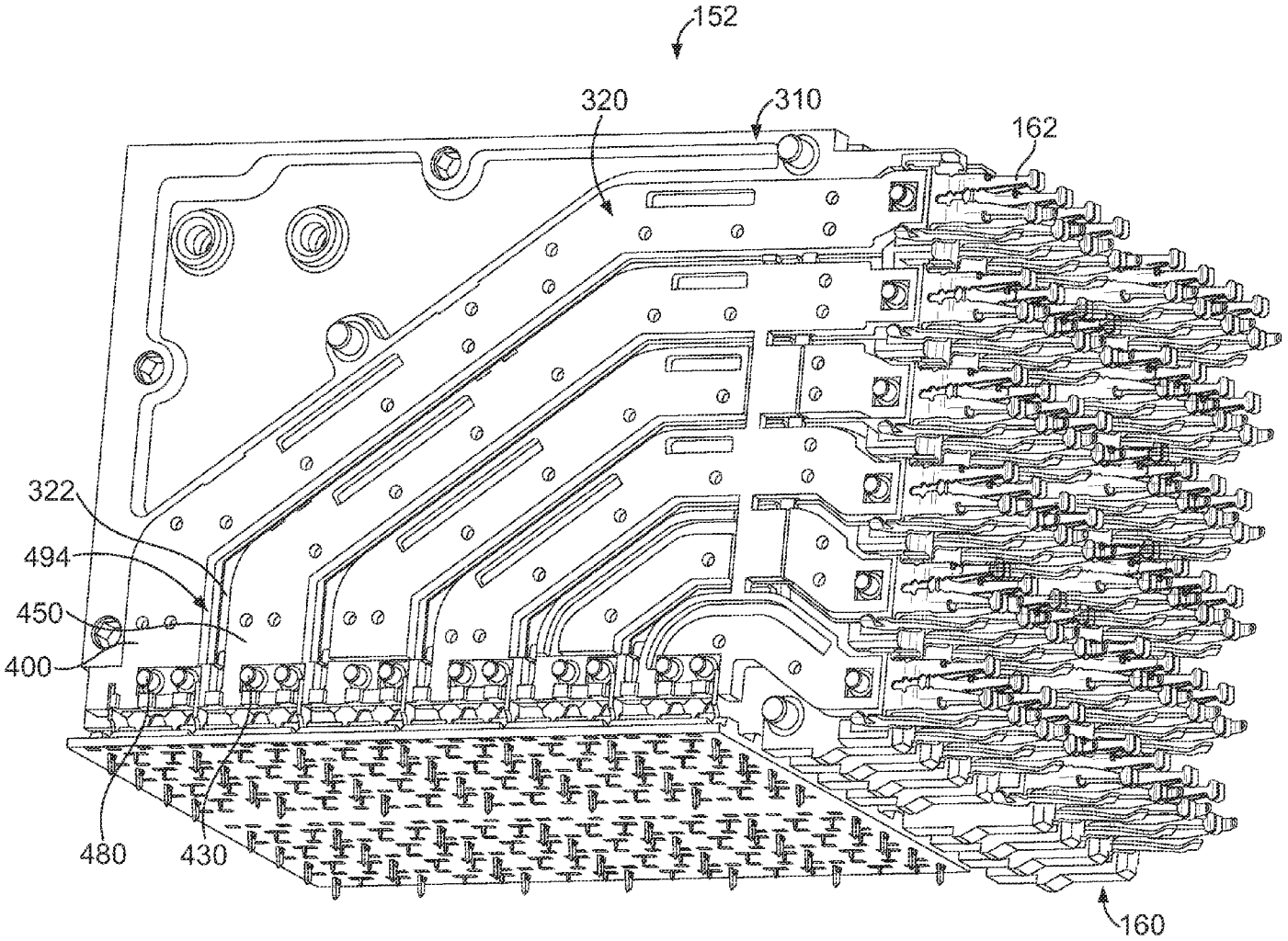
FIG. 11 illustrates a portion of the second receptacle assembly showing a plurality of contact modules arranged in a stacked configuration.

FIG. 11 illustrates a portion of the second receptacle assembly 152 showing a plurality of the contact modules 160 arranged in a stacked configuration. The contact module 160 at the near end is shown with the holder member 314 (shown in FIG. 5) removed for clarity to illustrate the frame assembly 320. The frame assembly 320 is loaded into the conductive holder 310 such that the tabs 322 extend into the windows 494 between the frame members 400, 450 and thus between the differential pairs of receptacle signal contact 162. The locating posts 430, 480 serve to position the frame assembly 320 within the conductive holder 310.

Figure 12:
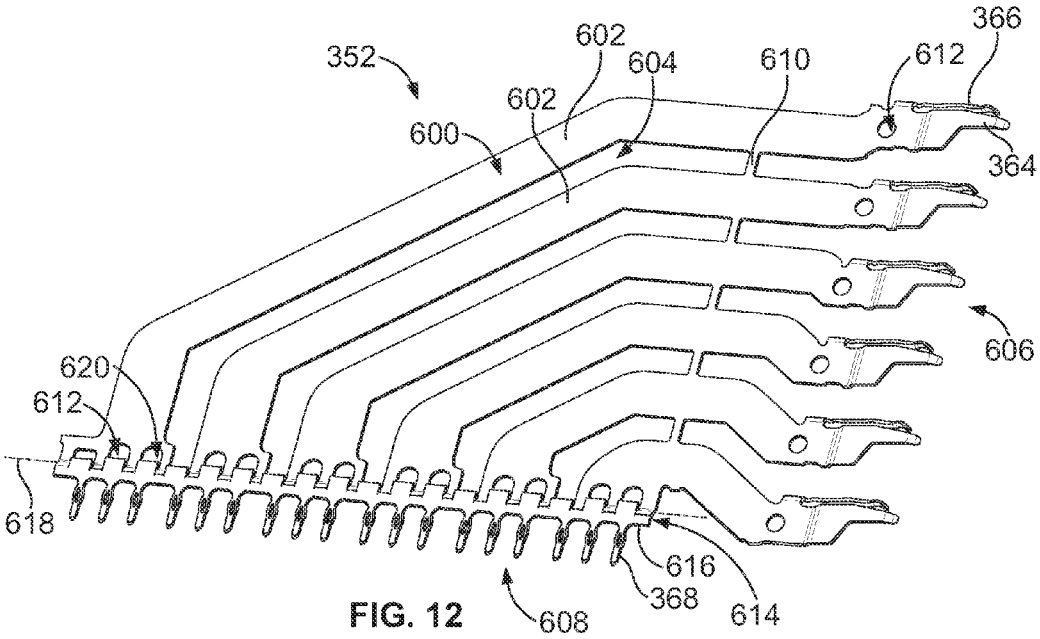
FIG. 12 is a side perspective view of a ground shield for the contact module shown in FIG. 5 and formed in accordance with an exemplary embodiment.

FIG. 12 is a side perspective view of the second ground shield 352 formed in accordance with an exemplary embodiment. The second ground shield 352 includes a main body 600 that is configured to be received within the conductive holder 310 (shown in FIG. 5). The main body 600 includes a plurality of arms 602 separated by gaps 604. The main body 600 extends between a mating end 606 and a mounting end 608. The grounding beams 364, 366 extend from the main body 600 at the mating end 606. The ground pins 368 are provided at the mounting end 608. In the illustrated embodiment, the mating and mounting ends 606, 608 are oriented generally perpendicular to one another, however other orientations are possible in alternative embodiments.

The arms 602 extend between the grounding beams 364, 366, and the ground pins 368. The arms 602 are generally the portions of the second ground shield 352 housed within the conductive holder 310, while the grounding beams 364, 366 and ground pins 368 are the portions of the second ground shield 352 extending exterior of the conductive holder 310. The arms 602 are configured to extend along the frame members 400, 450 (shown in FIG. 9) transitioning within the conductive holder 310. Each arm 602 is sized and shaped to transition along the corresponding differential pair of receptacle signal contacts 162 (shown in FIG. 5). The arms 602 are wide enough to cover both receptacle signal contacts 162 of the corresponding differential pair.

The arms 602 are connected by cross beams 610 that extend across the gaps 604. The cross beams 610 hold the arms 602 in position relative to each other. The gaps 604 are sized and shaped to receive corresponding tabs 322 and/or 324 (shown in FIG. 5) of the conductive holder 310.

The arms 602 include openings 612 extending therethrough. The openings 612 are configured to receive locating posts 430, 480 (shown in FIG. 9) extending from the frames 330, 332 (shown in FIG. 9) to position the second ground shield 352 with respect to the frame assembly 320 (shown in FIG. 9). The openings 612 may receive posts extending from the conductive holder 310 rather than the frames 330, 332. Optionally, each arm 602 may include an opening 612 proximate to the grounding beams 364, 366 and another opening 612 proximate to the ground pins 368. As such, the anus 602 are supported near the mating and mounting ends 306, 308 of the second ground shield 352.

In an exemplary embodiment, the second ground shield 352 is stamped and formed. The arms 602 are defined by a stamping process where material is removed to form the gaps 604 between the arms 602. The grounding beams 364 and/or 366 are bent and formed to define spring beams that are configured to engage the header ground shields 122 (shown in FIG. 1). The ground pins 368 are stamped and may be bent to a certain position for coupling with the second circuit board 150 (shown in FIG. 1).

In an exemplary embodiment, the ground shield 352 includes a jogged section 614 at the mounting end 608. The jogged section 614 transitions between a mounting edge 616 and the main body 600. The jogged section 614 transitions out of plane with respect to a ground shield plane defined by the main body 600. For example, the ground shield 352 is bent at a bend line 618 out of the ground shield plane to define the jogged section 614. The jogged section 614 may have a curved transition or may be an angular transition at the bend line 618. The jogged section 614 transitions the mounting edge 616, and thus the ground pins 368 that extend from the mounting edge 616, out of the ground shield plane. In an exemplary embodiment, the jogged section 614 transitions in such a way that the ground pins 368 are parallel to the ground shield plane, but are non-coplanar with the ground shield plane. The transition is used to position the ground pins 368 for mounting to the circuit board 150 (shown in FIG. 1). For example, the ground pins 368 may need to be spaced at a certain distance from the mounting portions 422 (shown in FIG. 7) of the receptacle signal contacts 162.

Having the ground pins 368 offset from the main body 600 may cause damage to the ground pins 368 during mounting to the circuit board 150. For example, forces exerted on the ground pins 368 may cause the ground pins 368 to buckle and/or shear due to being offset from the main body 600. In an exemplary embodiment, features are provided to mitigate the buckling forces on the ground pins 368. For example, in an exemplary embodiment, the ground shield 352 includes bearing surfaces 620 proximate to the ground pins 368. The bearing surfaces 620 are provided at the mounting end 608. The bearing surface 620 serve to transfer the forces imparted on the ground pins 368 during mounting to the second circuit board 150 from the second ground shield 352 to the conductive holder 310 and/or the frame assembly 320. Having the bearing surfaces 620 close to the ground pins 368 mitigates buckling of the ground pins 368.

Figure 13:
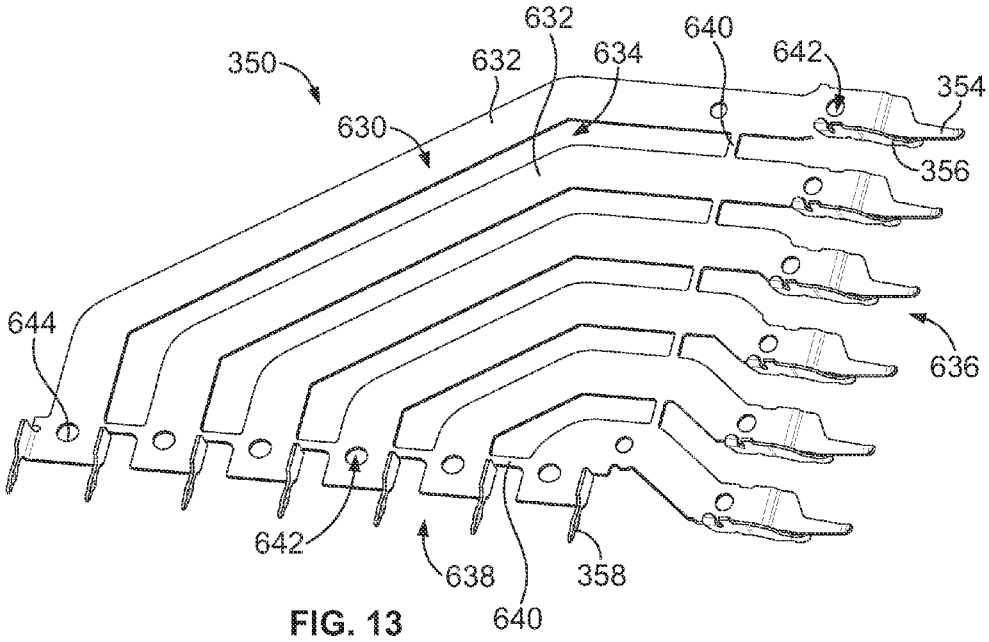
FIG. 13 is a side perspective view of a ground shield for the contact module shown in FIG. 5 and formed in accordance with an exemplary embodiment.

FIG. 13 is a side perspective view of the first ground shield 350 formed in accordance with an exemplary embodiment. The first ground shield 350 includes a main body 630 that is configured to be received within the conductive holder 310 (shown in FIG. 5). The main body 630 includes a plurality of arms 632 separated by gaps 634. The main body 630 extends between a mating end 636 and a mounting end 638. The grounding beams 354, 356 extend from the main body 630 at the mating end 636. The ground pins 358 are provided at the mounting end 638. In the illustrated embodiment, the mating and mounting ends 636, 638 are oriented generally perpendicular to one another, however other orientations are possible in alternative embodiments.

The arms 632 extend between the grounding beams 354, 356, and the ground pins 358. The arms 632 are generally the portions of the first ground shield 350 housed within the conductive holder 310, while the grounding beams 354, 356 and ground pins 358 are the portions of the first ground shield 350 extending exterior of the conductive holder 310. The arms 632 are configured to extend along the frame members 400, 450 (shown in FIG. 9) transitioning within the conductive holder 310. Each arm 632 is sized and shaped to transition along the corresponding differential pair of receptacle signal contacts 162 (shown in FIG. 5). The arms 632 are wide enough to cover both receptacle signal contacts 162 of the corresponding differential pair.

The arms 632 are connected by cross beams 640 that extend across the gaps 634. The cross beams 640 hold the arms 632 in position relative to each other. The gaps 634 are sized and shaped to receive corresponding tabs 322 and/or 324 (shown in FIG. 5) of the conductive holder 310. Optionally, the cross beams 640 may be offset with respect to the cross beams 610 (shown in FIG. 12) when the contact module 160 is assembled, such as to improve crosstalk.

The arms 632 include openings 642 extending therethrough. The openings 642 are configured to receive locating posts 430, 480 (shown in FIG. 9) extending from the frames 330, 332 (shown in FIG. 9) to position the first ground shield 350 with respect to the frame assembly 320 (shown in FIG. 9). The openings 642 may receive posts extending from the conductive holder 310 rather than the frames 330, 332. Optionally, each arm 632 may include an opening 642 proximate to the grounding beams 354, 356 and another opening 642 proximate to the ground pins 358. As such, the arms 632 are supported near the mating and mounting ends 636, 638 of the first ground shield 350.

In an exemplary embodiment, the first ground shield 350 is stamped and formed. The arms 632 are defined by a stamping process where material is removed to form the gaps 634 between the arms 632. The grounding beams 354 and/or 356 are bent and formed to define spring beams that are configured to engage the header ground shields 122 (shown in FIG. 1). The ground pins 358 are stamped and may be bent to a position for coupling with the second circuit board 150 (shown in FIG. 1).

In an exemplary embodiment, the first ground shield 350 includes bearing surfaces 644 proximate to the ground pins 358. The bearing surfaces 644 are provided at the mounting end 638. The bearing surfaces 644 serve to transfer the forces imparted on the ground pins 358 during mounting to the circuit board 150 from the first ground shield 350 to the conductive holder 310 and/or the frame assembly 320. In the illustrated embodiment, the bearing surfaces 644 are defined by the openings 642.

Figure 14:
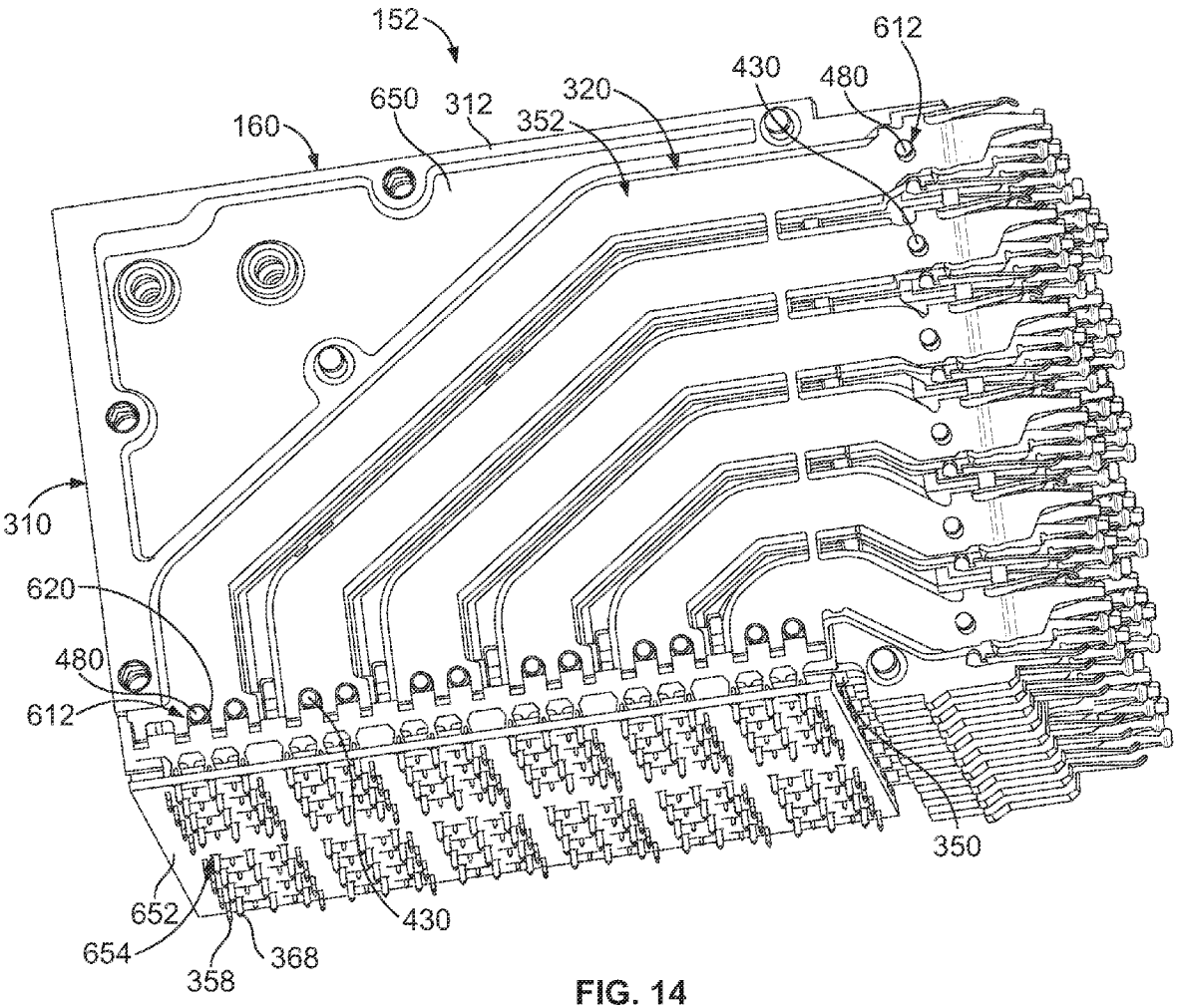
FIG. 14 is a side perspective view of a portion of the second receptacle assembly.

FIG. 14 is a side perspective view of a portion of the second receptacle assembly 152 with the second holder member 314 (shown in FIG. 5) of the near end contact module 160 removed to illustrated the frame assembly 320 and the second ground shield 352. When assembled, the first ground shield 350 is loaded into the first holder member 312 and abuts against an interior wall surface 650 of the first holder member 312. The frame assembly 320 is positioned within the conductive holder 310 against the first ground shield 350. The second ground shield 352 is coupled to the frame assembly 320. The locating posts 430, 480 are received in the openings 612 to secure the second ground shield 352 to the frame assembly 320. The bearing surfaces 620 defined by the openings 612 bear against the locating posts 430, 480 to transfer forces between the second ground shield 352 and the frame assembly 320. The second holder member 314 (not shown) may be coupled to the first holder member 312 over the frame assembly 320 and the second ground shield 352. Other assembly methods are possible in alternative embodiments.

An organizer 652 is provided at the mounting end. The organizer 652 includes openings 654 that receive the ground pins 358, 368. The organizer 652 holds the true positions of the ground pins 358, 368 for mounting to the second circuit board 150 (shown in FIG. 1). The organizer 652 may be pressed onto the ground pins 358 during mounting of the second receptacle assembly 152 to the second circuit board 150.

Figure 15:
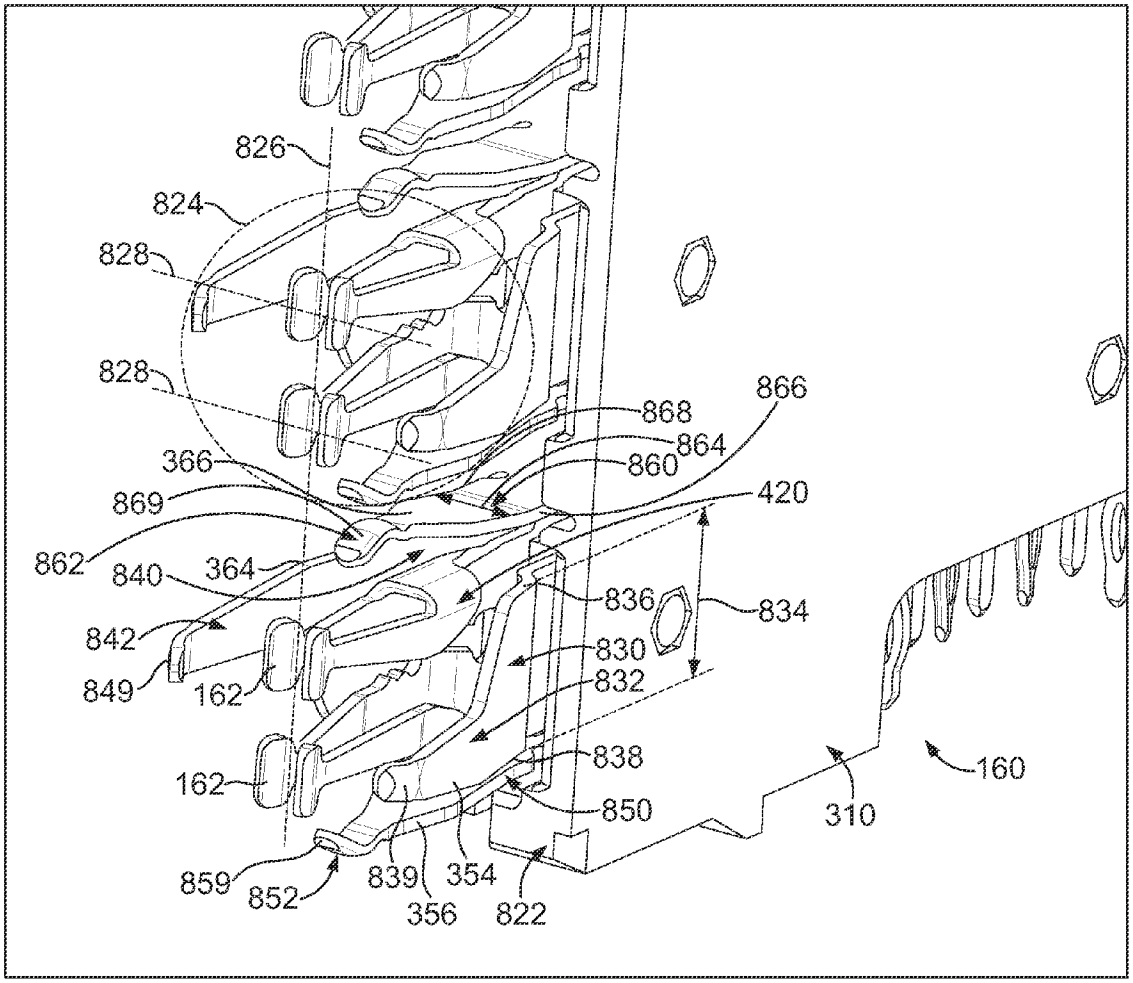
FIG. 15 is a front perspective view of a portion of the contact module shown in FIG. 5.

FIG. 15 is a front perspective view of a portion of one of the contact modules 160. The mating portions 420 of the receptacle signal contacts 162 extend forward from a mating end 822 of the conductive holder 310. The grounding beams 354, 356, 364, 366 extend forward from the mating end 822 of the conductive holder 310 along the mating portions 420 of the receptacle signal contacts 162. In an exemplary embodiment, the grounding beams 354, 356, 364, 366 are arranged in beam sets 824. Each beam set 824 surrounds a different differential pair of receptacle signal contacts 162. In an exemplary embodiment, each beam set 824 surrounds the differential pair of receptacle signal contacts on four sides thereof.

The receptacle signal contacts 162 of each pair are arranged in a single column with the other receptacle signal contacts 162 of the other differential pairs of the contact module 160. For example, all of the receptacle signal contacts 162 of the contact module 160 are aligned along a column axis 826. The in-column grounding beams 356, 366 are also arranged in column with the receptacle signal contacts 162 along the column axis 826. The in-column grounding beams 356, 366 provide shielding between adjacent differential pairs of receptacle signal contacts 162 that are held in the same contact module 160. In an exemplary embodiment, because each differential pair of receptacle signal contacts 162 includes grounding beams on all four sides, two grounding beams 356, 366 (of different beam sets 824) are provided between each differential pair of receptacle signal contacts 162. For example, the in-column grounding beam 366 of one beam set 824 and the in-column grounding beam 356 of another beam set 824 are both positioned between adjacent differential pairs of the receptacle signal contacts 162. Such in column grounding beams 356, 366 of the different beam sets 824 are configured to engage different header ground shields 122 (shown in FIG. 1).

The flanking grounding beams 354, 364 are offset with respect to the receptacle signal contacts 162 and the column axis 826. The flanking grounding beams 354, 364 flank the corresponding differential pairs of receptacle signal contacts 162 on opposite sides thereof. Row axes 828 extend through each of the receptacle signal contacts 162 perpendicular to the column axis 826. For each differential pair of receptacle signal contacts 162, each of the flanking ground beams 354, 364 of the corresponding beam set 824 is aligned with the row axis 828 of a corresponding one of the receptacle signal contacts 162, at least along a portion of the length of such receptacle signal contact 162. The flanking grounding beams 354, 364 are sufficiently wide to provide electrical shielding along both receptacle signal contacts 162 of the corresponding differential pair.

The flanking grounding beam 354 includes a base portion 830 proximal the mating end 822 of the conductive holder 310. The flanking grounding beam 354 includes a tail portion 832 distal of the mating end 822 of the conductive holder 310. The base portion 830 has a base width 834 extending between a first side edge 836 and a second side edge 838 of the base portion 830. The tail portion 832 is narrower than the base portion 830. Optionally the tail portion 832 may taper to a tip 839. The tip 839 generally defines a mating interface for the flanking grounding beam 354. In an exemplary embodiment, the tail portion 832 is offset toward the second side edge 838 rather than being centered between the first and second side edges 836, 838. Having the tail portion 832 offset allows the tail portion 832 to be aligned with one of the receptacle signal contacts 162 of the corresponding differential pair and to be non-aligned with the other receptacle signal contact 162 of such differential pair. The tail portion 832 is aligned with the row axis 828 of the corresponding receptacle signal contact 162.

The flanking grounding beam 364 includes a base portion 840 proximal to the mating end 822 of the conductive holder 310. The flanking grounding beam 364 includes a tail portion 842 distal of the mating end 822 of the conductive holder 310. The base portion 840 has a base width extending between a first side edge and a second side edge of the base portion 840, similar to the flanking grounding beam 354. The tail portion 842 is narrower than the base portion 840. Optionally the tail portion 842 may taper to a tip 849. The tip 849 generally defines a mating interface for the flanking grounding beam 364. In an exemplary embodiment, the tail portion 842 is offset toward the first side edge rather than being centered between the first and second side edges. The tail portion 842 is offset with respect to the tail portion 832 of the flanking grounding beam 364 such that the tail portion 842 extends along one of the receptacle signal contacts 162 while the tail portion 832 of the flanking ground beam 354 extends along the other receptacle signal contact 162 of the differential pair. The tail portion 842 is aligned with the row axis 828 of the corresponding receptacle signal contact 162.

The in-column grounding beam 356 includes a base portion 850 proximal the mating end 822 of the conductive 310. The in-column grounding beam 356 includes a tail portion 852 distal of the mating end 822 of the conductive holder 310. The base portion 850 has a base width extending between a first side edge and a second side edge of the base portion 850. The tail portion 852 is narrower than the base portion 850. Optionally the tail portion 852 may taper to a tip 859. The tip 859 generally defines a mating interface for the in-column grounding beam 356. The tail portion 852 is aligned in-column with the receptacle signal contacts 162.

The in-column grounding beam 366 includes a base portion 860 proximal the mating end 822 of the conductive 310. The in-column grounding beam 366 includes a tail portion 862 distal of the mating end 822 of the conductive holder 310. The base portion 860 has a base width 864 extending between a first side edge 866 and a second side edge 868 of the base portion 860, similar to the in-column grounding beam 356. The tail portion 862 is narrower than the base portion 860.

Optionally the tail portion 862 may taper to a tip 869. The tip 869 generally defines a mating interface for the in-column grounding beam 366. The tail portion 862 is aligned in-column with the receptacle signal contacts 162.

The wider base portions, 830, 840, 850, 860 provide electrical shielding around all sides of the differential pairs of receptacle signal contacts near the mating end 822 of the conductive holder 310. When the header ground shields 122 are not fully mated, and thus are spaced apart from the mating end 822, the base portions, 830, 840, 850, 860 provide full shielding on all four sides of the receptacle signal contacts 162. The narrower tail portions 832, 842, 852, 862 provide mechanical spring characteristics for the grounding beams 354, 356, 364, 366. The size and shapes of the grounding beams 354, 356, 364, 366 are designed to balance the electrical shielding characteristics with the mechanical spring characteristics.

Figure 16:
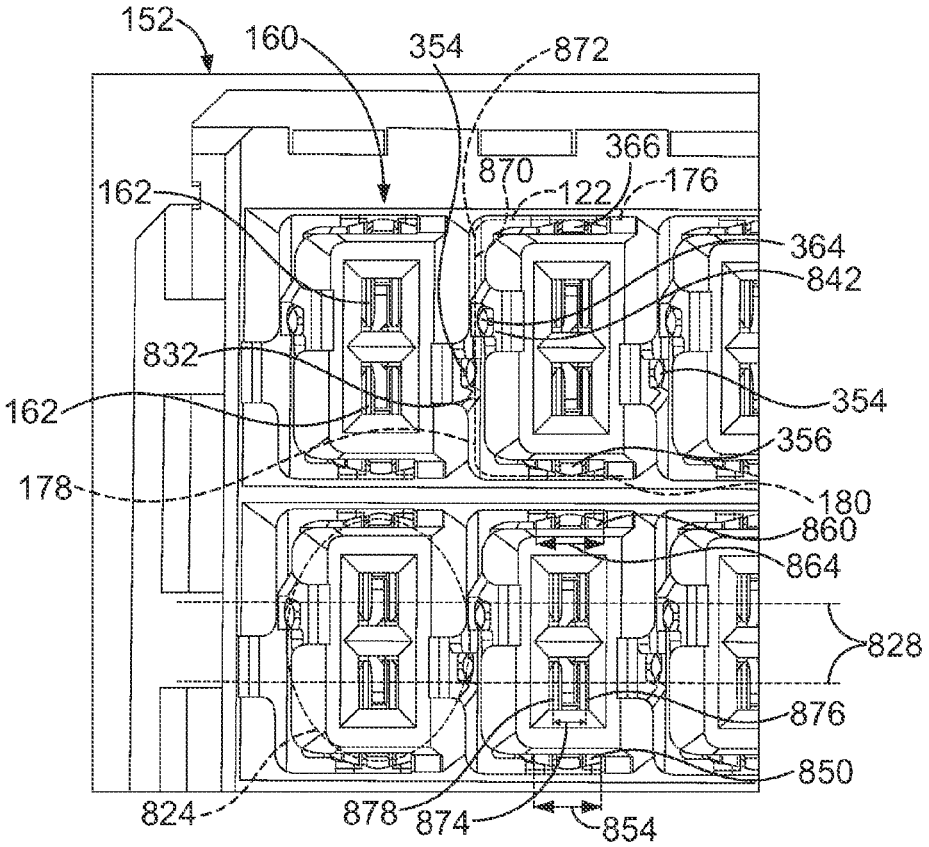
FIG. 16 is a front view of a portion of the second receptacle assembly showing a plurality of contact modules arranged in a stacked configuration.

FIG. 16 is a front view of a portion of the second receptacle assembly 152 showing a plurality of contact modules 160 arranged in a stacked configuration. The beam sets 824 are illustrated surrounding all four sides of the corresponding differential pairs of receptacle signal contacts 162. A header ground shield 122 is shown in phantom in FIG. 16 to illustrate the position of the header ground shields 122 with respect to the beam sets 824 and the receptacle signal contacts 162. The header ground shields 122 are C-shaped and extend along three sides of the differential pair of receptacle signal contacts 162.

The in-column grounding beam 356 engages an interior side of the side wall 180 of the header ground shield 122. The in-column grounding beam 366 engages the interior side of the sidewall 176 of the header ground shield 122. The flanking grounding beam 364 engages an interior side 870 of the center wall 178 of the header ground shield 122. The flanking grounding beam 354 of an adjacent beam set 824 engages an exterior side 872 of the center wall 178 of the header ground shield 122. As such, three of the grounding beams 356, 364, 366 engage a common header ground shield 122 while the other grounding beam 354 engages a different header ground shield 122. As such, each beam set 824 is configured to engage two different header ground shields 122. Having the flanking grounding beams 354, 364 allows the first ground shield 350 of one contact module 160 to be electrically commoned with the second ground shield 352 of the adjacent contact module 160. It also allows the header ground shields 122 to be electrically commoned to ground shields 350, 352 of different contact modules 160. The ground energy is referenced to both contact modules 160. Well referenced return paths are thus provided by the beam sets 824. The electrical performance of the second receptacle assembly 152 is enhanced by having the beam sets 824 electrically connected to more than one header ground shield 122.

In an exemplary embodiment, the offset of the tail portions 832, 842 of the adjacent flanking grounding beams 354, 364 (in different beam sets 824) allows interesting of such grounding beams 354, 364, such as when the grounding beams 354, 364 are in an undeflected state. The grounding beams 354, 364 are staggered to fit in the limited space between the contact modules 160. FIG. 16 also illustrates that the flanking ground beams 354 of different beam sets 824 are aligned along a common row axis 828 while the flanking grounding beams 364 of different beam sets 824 are aligned with a different row axis 828.

The receptacle signal contacts 162 have a transverse width 874 measured in a transverse direction, which is parallel to the row axes 828. The transverse width 874 is measured from an outside edge 876 of the receptacle signal contacts 162 to an opposite outside edge 878 of the receptacle signal contacts 162. Base widths 854, 864 of the base portions 850, 860, respectively, are approximately equal to the transverse widths 874 of the receptacle signal contacts 162. The base widths 854, 864 may be slightly greater than the transverse width 874 or slightly narrower than the transverse width 874. The base widths 854, 864 are wide enough to cover the majority of the transverse width 874 of the receptacle signal contacts 162.

Figure 17:
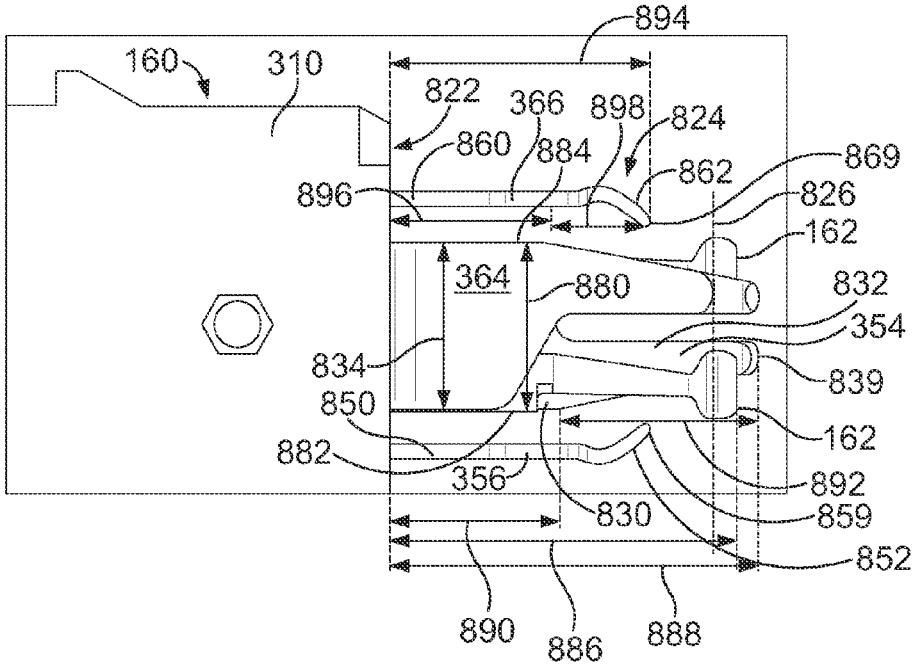
FIG. 17 is a side view of a portion of the contact module shown in FIG. 5.

FIG. 17 is a side view of a portion of one of the contact modules 160. A pair of the receptacle signal contacts 162 is shown with the corresponding beam set 824 surrounding four sides of the pair of receptacle signal contacts 162. The receptacle signal contacts 162 have a lateral width 880 measured in a lateral direction, which is parallel to the column axis 826. The lateral width 880 is measured from an outside edge 882 of one of the receptacle signal contacts 162 to an opposite edge 884 of the other receptacle signal contact 162 of the pair. The base width 834 of the base portion 830 is approximately equal to the lateral width 880. The base width 834 may be slightly greater than the lateral width 880 or slightly narrower than the lateral width 880. The base width 834 is wide enough to cover the majority of both of the receptacle signal contacts 162.

The mating portions 420 (shown in FIGS. 6 and 7) of the receptacle signal contacts 162 have longitudinal lengths 886 measured from the mating end 822 of the conductive holder 310 to the distal ends of the receptacle signal contacts 162. The longitudinal lengths 886 are measured longitudinally along the receptacle signal contacts 162. The flanking grounding beam 354 has a beam length 888 measured from the mating end 822 of the conductive holder 310 to the tip 839. The base portion 830 has a base portion length 890 and the tail portion 832 has a tail portion length 892. Optionally, the base portion length 890 may be at least half of the beam length 888. The flanking grounding beam 364 has similar dimensions as the flanking grounding beam 354.

The in-column grounding beams 356, 366 have beam lengths 894 measured from the mating end 822 of the conductive holder 310 to the tips 859, 869. The base portions 850, 860 have base portion lengths 896 and the tail portions 852, 862 have tail portion lengths 898. Optionally, the base portion lengths 896 may be at least half of the beam lengths 894.

Figure 18:
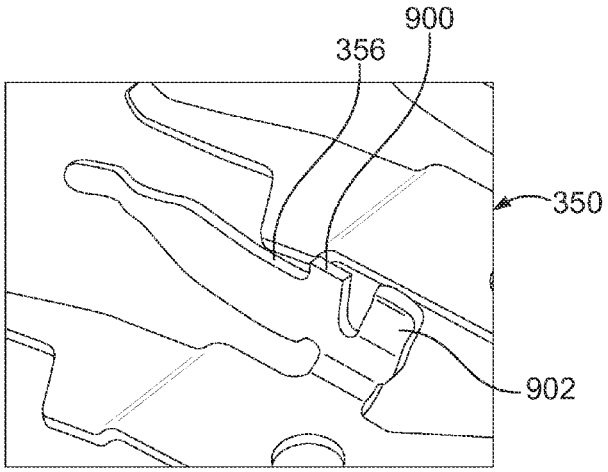
FIG. 18 illustrates a portion of the ground shield shown in FIG. 12.

FIG. 18 illustrates a portion of the first ground shield 350. The first ground shield 350 includes a locating tab 900. In the illustrated embodiment, the locating tab 900 extends from a portion of the first ground shield 350 interior of the grounding beam 356. The locating tab 900 is configured to be positioned interior of the conductive holder 310 (shown in FIG. 5). The locating tab 900 is used to position the first ground shield 350 within the conductive holder 310.

The first ground shield 350 includes a shunt tab 902. The shunt tab 902 is configured to be spring biased against the conductive holder 310 to ensure an electrical connection is made between the first ground shield 350 and the conductive holder 310. The shunt tab 902 may be deflectable.

Figure 19:
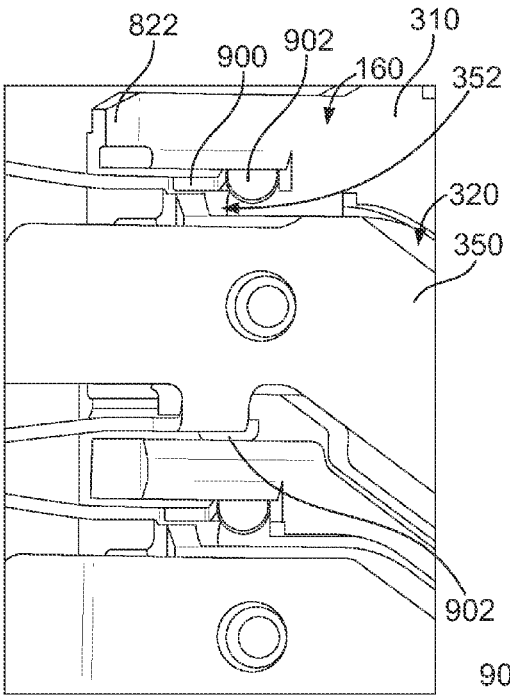
FIG. 19 illustrates a portion of the contact module shown in FIG. 5.

FIG. 19 illustrates a portion of the contact module 160 with the first holder member 312 (shown in FIG. 5) removed to illustrate the frame assembly 320 and the ground shields 350, 352. The second ground shield 352, similar to the first ground shield 350, includes a locating tab 900 and a shunt tab 902. The conductive holder 310 includes recesses that receive the locating tabs 900 and shunt tabs 902 of the first and second ground shields 350, 352. The shunt tabs 902 are biased against surfaces of the conductive holder 310 to ensure an electrical connection between the ground shields 350, 352 and the conductive holder 310. The shunt tabs 902 are located near the mating end 822 of the conductive holder 310 to electrically connect the ground shields 350, 352 to the conductive holder 310 proximate to the mating end 822. As such, the ground energy from the header ground shield 122 (shown in FIG. 1) is transferred to the conductive holder 310 proximate to the grounding beams 356, 366.

Figure 20:
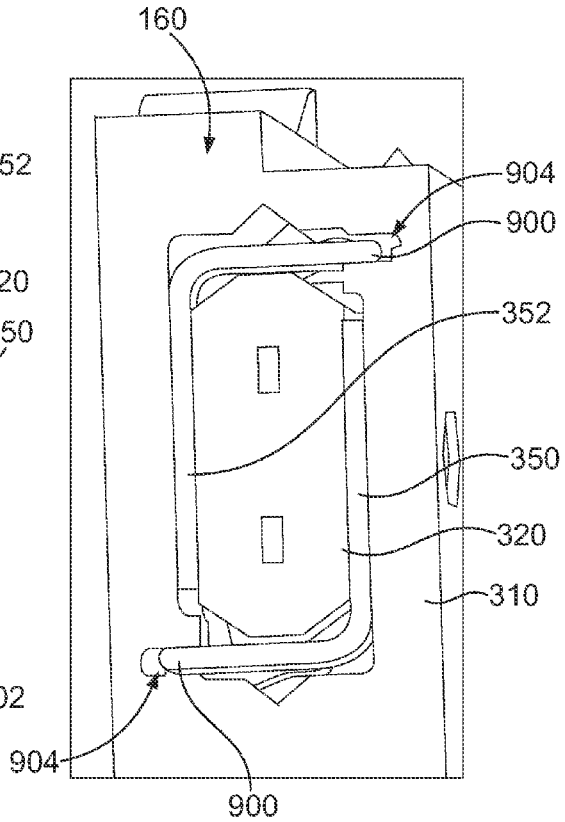
FIG. 20 is a cross-sectional view of the contact module shown in FIG. 5.

FIG. 20 is a cross-sectional view of the contact module 160. The locating tabs 900 of the first and second ground shields 350, 352 are shown received in corresponding locating slots 904 in the conductive holder 310. The locating tabs 900 are used to locate the ground shields 350, 352 with respect to the conductive holder 310, and thus, the frame assembly 320.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle assembly comprising:

a receptacle housing having a mating end; and a contact module received in the housing, the contact module comprising:

a conductive holder;

a frame assembly received in the conductive holder and electrically shielded by the conductive holder, the frame assembly having a plurality of receptacle signal contacts adjacent to each other, the receptacle signal contacts having mating portions extending beyond the conductive holder, the receptacle signal contacts being arranged in differential pairs carrying differential signals; and ground shields received in the conductive holder between the frame assembly and the conductive holder, the ground shields having grounding beams extending along the mating portions of the receptacle signal contacts, the grounding beams being arranged in beam sets, each beam set surrounding a different differential pair of receptacle signal contacts, the grounding beams of each beam set being arranged on four sides of the corresponding differential pair of the receptacle signal contacts.

2. The receptacle assembly of claim 1, wherein the grounding beams of different beam sets of the contact module are positioned between adjacent differential pairs of receptacle signal contacts in a receptacle signal contact-receptacle signal contact-grounding beam-grounding beam-receptacle signal contact-receptacle signal contact pattern.

3. The receptacle assembly of claim 1, wherein the ground shields are inlayed in the conductive holder between the frame assembly and an interior wall surface of the conductive holder.

4. The receptacle assembly of claim 1, wherein the conductive holder includes a mating end, the mating portions of the receptacle signal contacts and the grounding beams extending beyond the mating end of the conductive holder, the ground shields include shunt tabs engaging the conductive holder proximate the mating end to electrically connect the ground shield to the conductive holder proximate to the mating end.

5. The receptacle assembly of claim 1, wherein the receptacle signal contacts are arranged in a single column along a front of the frame assembly, two of the grounding beams of each set being arranged in column with the receptacle signal contacts, two of the grounding beams of each set being offset from the column and flanking the differential pair of receptacle signal contacts.

6. The receptacle assembly of claim 1, wherein the grounding beams are configured to engage corresponding header ground shields, wherein the grounding beams of each beam set are configured to engage more than one header ground shield.

7. The receptacle assembly of claim 1, wherein the receptacle signal contacts have a lateral width measured from an outside edge of one receptacle signal contact of each pair to an opposite outside edge of the other receptacle signal contact of the pair, each grounding beam having a base portion proximal a mating end of the conductive holder and a tail portion distal of the mating end of the conductive holder, the base portion having a base width approximately equal to the lateral width, the tail portion being narrower than the base portion, the base portion extending at least half of a longitudinal length of the ground beam.

8. A receptacle assembly comprising:

a receptacle housing having a mating end; and a plurality of contact modules received in the housing, each contact module comprising:

a conductive holder;

a frame assembly received in the conductive holder and electrically shielded by the conductive holder, the frame assembly having a plurality of receptacle signal contacts adjacent to each other, the receptacle signal contacts having mating portions extending beyond the conductive holder, the receptacle signal contacts being arranged in differential pairs carrying differential signals; and ground shields coupled to the conductive holder, the ground shields having grounding beams extending along the mating portions of the receptacle signal contacts, the grounding beams being configured to engage header ground shields of a header assembly, the grounding beams being arranged as beam sets, each beam set surrounding a different differential pair of receptacle signal contacts, wherein the grounding beams of each beam set are configured to engage more than one header ground shield.

9. The receptacle assembly of claim 8, wherein the grounding beam of one beam set is configured to engage a first side of the corresponding header ground shield and the grounding beam of another beam set is configured to engage a second side of such header ground shield.

10. The receptacle assembly of claim 8, wherein the receptacle signal contacts of each contact module are arranged in a single column, the contact modules being stacked adjacent each other such that the columns of receptacle signal contacts are parallel to each other and such that the receptacle signal contacts are arranged in rows, grounding beams from different beam sets being aligned with the rows of receptacle signal contacts.

11. The receptacle assembly of claim 8, wherein the contact modules define a first contact module and a second contact module, the receptacle signal contacts of the first contact module defining a first differential pair, the receptacle signal contacts of the second contact module defining a second differential pair, the receptacle signal contacts of the first differential pair being aligned with the receptacle signal contacts of the second differential pair, the beam set associated with the first differential pair having a first grounding beam aligned with and extending between corresponding receptacle signal contacts of the first and second differential pairs, the beam set associated with the second differential pair having a second grounding beam staggered with respect to the first grounding beam and aligned with and extending between different receptacle signal contacts of the first and second differential pairs.

12. The receptacle assembly of claim 8, wherein each beam set surrounds the corresponding differential pair of receptacle signal contacts on four sides.

13. The receptacle assembly of claim 8, wherein the ground shields are inlayed in the conductive holder between the frame assembly and an interior wall surface of the conductive holder.

14. The receptacle assembly of claim 8, wherein the conductive holder includes a mating end, the mating portions of the receptacle signal contacts and the grounding beams extending beyond the mating end of the conductive holder, the ground shields include shunt tabs engaging the conductive holder proximate the mating end to electrically connect the ground shield to the conductive holder proximate to the mating end.

15. The receptacle assembly of claim 8, wherein the receptacle signal contacts are arranged in a single column along a front of the frame assembly, two of the grounding beams of each set being arranged in column with the receptacle signal contacts, two of the grounding beams of each set being offset from the column and flanking the differential pair of receptacle signal contacts.

16. The receptacle assembly of claim 8, wherein the receptacle signal contacts have a lateral width measured from an outside edge of one receptacle signal contact of each pair to an opposite outside edge of the other receptacle signal contact of the pair, each grounding beam having a base portion proximal a mating end of the conductive holder and a tail portion distal of the mating end of the conductive holder, the base portion having a base width approximately equal to the lateral width, the tail portion being narrower than the base portion, the base portion extending at least half of a longitudinal length of the ground beam.

17. A receptacle assembly comprising:

a receptacle housing having a mating end; and a contact module received in the housing, the contact module comprising:

a conductive holder having a mating end;

a frame assembly received in the conductive holder and electrically shielded by the conductive holder, the frame assembly having a plurality of receptacle signal contacts adjacent to each other, the receptacle signal contacts having mating portions extending beyond the mating end of the conductive holder, the receptacle signal contacts being arranged in differential pairs carrying differential signals, the receptacle signal contacts having a lateral width measured from an outside edge of one receptacle signal contact of each pair to an opposite outside edge of the other receptacle signal contact of each pair; and ground shields coupled to the conductive holder, the ground shields having grounding beams extending longitudinally beyond the mating end of the conductive holder along the mating portions of the receptacle signal contacts, each grounding beam having a base portion proximal the mating end of the conductive holder and a tail portion distal of the mating end of the conductive holder, the base portion having a base width at least as wide as the lateral width, the tail portion being narrower than the base portion, the base portion extending at least half of a longitudinal length of the grounding beam.

18. The receptacle assembly of claim 17, wherein the receptacle signal contacts comprise a first receptacle signal contact and a second receptacle signal contact forming a first differential pair, the first and second receptacle signal contacts being aligned in a column along a column axis, the grounding beams comprising a first grounding beam offset from the column axis and aligned in row with the first receptacle signal contact, the grounding beams comprising a second grounding beam offset from the column axis in an opposite direction as the first grounding beam and aligned in row with the second receptacle signal contact.

19. The receptacle assembly of claim 17, wherein the grounding beams are arranged in beams sets, each beam set surrounding a different differential pair of receptacle signal contacts, each beam set surrounding the differential pair of receptacle signal contacts on four sides.

20. The receptacle assembly of claim 17, wherein the ground shields are inlayed in the conductive holder between the frame assembly and an interior wall surface of the conductive holder.

* * * * *